US005362208A

United States Patent [19]

Inagaki et al.

[11] Patent Number: 5,362,208

[45] Date of Patent: Nov. 8, 1994

[54] SWASH PLATE TYPE COMPRESSOR

[75] Inventors: Mitsuo Inagaki; Mikio Matsuda, both of Okazaki; Shinya Ishihara, Anjyo; Motohiko Ueda, Nishio; Hideaki Sasaya, Okazaki; Takeshi Sakai, Chiryu, all of Japan

[73] Assignees: Nippondenso Co., Ltd., Kariya; Nippon Soken, Inc., Nishio, both of Japan

[21] Appl. No.: 26,058

[22] Filed: Mar. 3, 1993

[30] Foreign Application Priority Data

| | | | |
|---|---|---|---|
| Mar. 4, 1992 | [JP] | Japan | 4-046974 |
| May 6, 1992 | [JP] | Japan | 4-113716 |
| Jan. 13, 1993 | [JP] | Japan | 5-003995 |

[51] Int. Cl.[5] ..... F04B 1/12

[52] U.S. Cl. ..... 417/269; 417/222.2; 91/499

[58] Field of Search ..... 417/269, 222.1, 222.2; 91/499

[56] References Cited

U.S. PATENT DOCUMENTS

| | | | |
|---|---|---|---|
| 2,160,978 | 6/1939 | Mock | 417/269 |
| 2,671,606 | 3/1954 | Ricardo | 417/270 |
| 3,482,521 | 12/1969 | Wolf | 417/269 |
| 3,696,710 | 10/1972 | Ortelli | 137/625.21 |
| 4,007,663 | 2/1977 | Nagatomo et al. | 417/269 |
| 4,174,191 | 11/1979 | Roberts | 417/269 |
| 4,781,539 | 11/1988 | Ikeda et al. | 417/269 |
| 5,032,060 | 7/1991 | Kobayashi | 417/269 |
| 5,207,078 | 5/1993 | Kimura et al. | 417/269 |
| 5,232,349 | 8/1993 | Kimura et al. | 417/222.1 |
| 5,267,839 | 12/1993 | Kimura et al. | 417/517 |

FOREIGN PATENT DOCUMENTS

| | | | |
|---|---|---|---|
| 4229069 | 3/1993 | Germany | 417/269 |
| 4235715 | 4/1993 | Germany | 417/269 |
| 60-003995 | 2/1985 | Japan . | |
| 5-66066 | 3/1993 | Japan | 417/269 |
| 5-71467 | 3/1993 | Japan | 417/269 |
| 5071468 | 3/1993 | Japan | 417/269 |
| 5113174 | 5/1993 | Japan | 417/269 |
| 5126038 | 5/1993 | Japan | 417/269 |
| 5126039 | 5/1993 | Japan | 417/269 |
| 5126040 | 5/1993 | Japan | 417/269 |
| 5164044 | 6/1993 | Japan | 417/269 |

*Primary Examiner*—Richard A. Bertsch
*Assistant Examiner*—Peter Korytnyk
*Attorney, Agent, or Firm*—Cushman, Darby & Cushman

[57] ABSTRACT

A swash plate type variable capacity compressor having rotary valves 16 and 17 that rotate together on a rotating shaft 1. The rotary valves 16 and 17 are arranged on the shaft 1 in such a manner that, upon one complete rotation, the rotary valves 16 and 17 are connected, in sequential manner, for respective rotating angles, with circumferentially spaced piston chambers Sp and Sp′ via respective intake passageways on the rotary valves 16 and 17. The arrangement of the intake passageway Pr and Pr′ is such that the value of the rotating angle in a communication between the intake passageways Pr and Pr′ and the piston chamber changes in accordance with the axial position of the rotary valves 16 and 17 on the shaft 1. Control of the rotating angle can vary the effective volume of the piston chambers Sp and Sp′, thereby continuously varying the compressor capacity.

34 Claims, 33 Drawing Sheets

Fig. 10A(1)
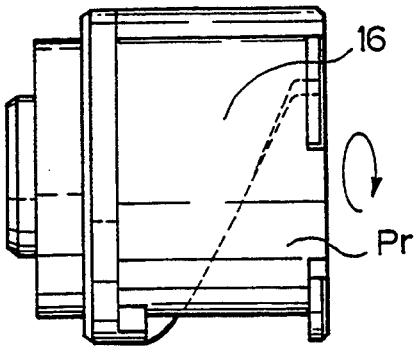
Fig. 10B(1)
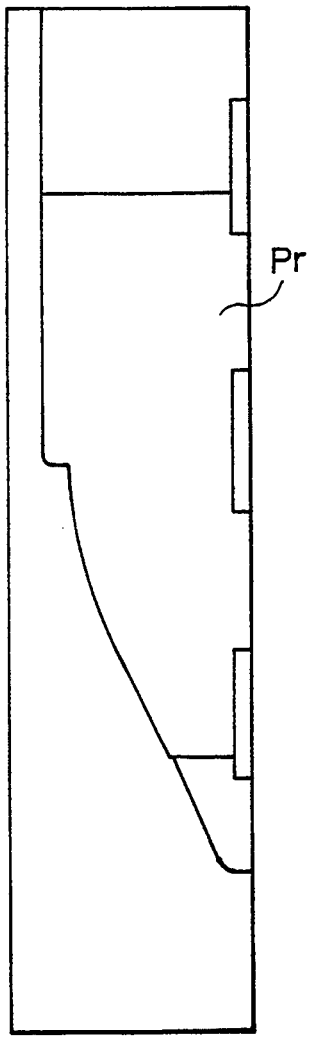

Fig. 10A(2)
MAXIMUM CAPACITY
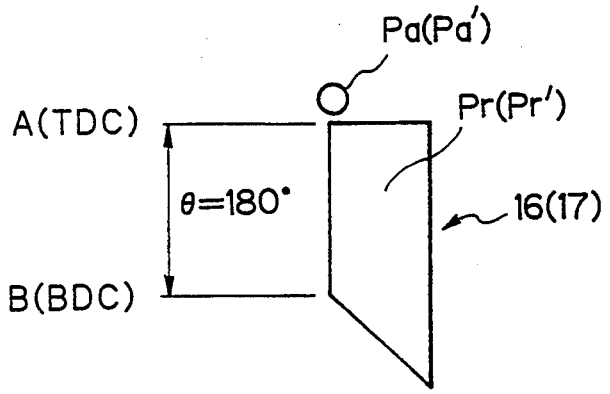
Fig. 10B(2)
MINIMUM CAPACITY
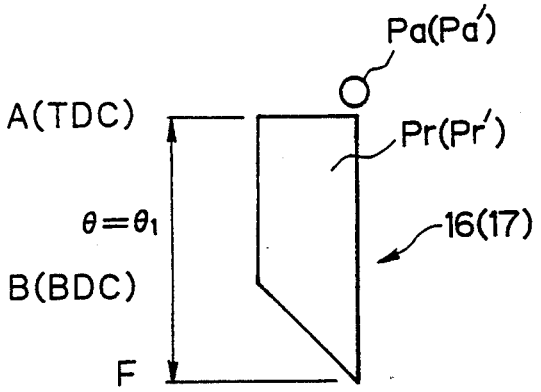

1
15
104
101
9
Vd
8
Ps
7
5
Pr
Sv
6
14
14
Sp'
Sv'
7
8'
9'
Pa'
Vd
100
13
11
50
104'
124'
P1
P3
P2
Vs
101'
17
4
Pr'
2
Vc
3
100
12
10
16
Vs
12x
13

SWASH PLATE TYPE COMPRESSOR

BACKGROUND OF THE INVENTION

1. Field of the Invention

The present invention relates to a swash plate type compressor, which is, for example, used for a refrigerant compressor of an air conditioning apparatus in an automobile.

2. Description of Related Art

Known in the prior art is a compressor that is provided with a cylinder block defining cylinder bores, with pistons axially and slidably inserted in the respective bores so that piston chambers are created, a rotating shaft rotating with respect to the cylinder block, and a swash plate mounted to a rotating shaft connected to pistons so that an axial movement of the pistons is obtained in receptive cylinder bores. A means is further provided for controlling an inclination angle of the swash plate with respect to the axis of the rotation of the rotating shaft for obtaining varied compressor capacities.

The prior art compressor is, however, defective in that the construction for changing the inclined angle of the swash plate is complicated, which reduces efficiency when it is produced. Furthermore, it is not very reliable, in particular, under high rotational speed conditions.

SUMMARY OF THE INVENTION

An object of the present invention is to provide a swash plate type variable compressor, having a simplified construction which is efficient when produced, and is reliable under high rotational speed operations.

According to the present invention, a variable capacity swash plate type compressor is provided, comprising:

a rotating shaft adapted for connection to the source of ratio;

a cylinder block with which the rotating shaft is rotated; the cylinder block forming a plurality of circumferentially spaced cylinder bores each extending parallel to an axis of the rotating shaft;

a plurality of pistons axially and slidably stored in the respective cylinder bore so that piston chambers are formed on respective sides of the pistons;

a swash plate fixedly connected to the rotating shaft, which is connected to the pistons to obtain an axial reciprocal movement of the piston when the shaft is rotated;

the volume of the piston chambers alternately increasing or decreasing upon the axial reciprocal movement of the corresponding pistons;

the cylinder block forming therein an intake pressure chamber that is connected to a source of a medium to be compressed, and a outlet pressure chamber for removing out the medium as compressed;

an intake means for controlling the introduction of the medium from the intake pressure chamber to the piston chambers, and a discharge means for controlling a discharge of the medium from the piston chambers to the outlet pressure chamber;

said intake means comprising:

a rotary valve that is axially and slidable with respect to the shaft while rotating together with the shaft, and a control means for controlling an axial position of the rotary valve on the shaft;

the rotary valve obtaining successive control of the communication of the intake pressure chamber with the circumferentially spaced piston chambers at respective ranges of a rotating angle upon one complete rotation of the rotary valve for introducing the medium to the respective piston chambers; said angle being controlled in accordance with the axial position of the rotary valve as obtained by said axial position control means.

The provision of the rotary valve axially moving on the rotating shaft can function to vary the capacity irrespective of its relatively simplified construction over the prior art, where an angle of a swash plate is controlled for varying capacity. Furthermore, the manufacturing process is easier, and a reliability during high speed operation can be obtained.

BRIEF DESCRIPTION OF ATTACHED DRAWINGS

FIG. 10A (1) shows a side elevational view of a rotary valve in a second embodiment.

FIG. 10B (1) shows a developed view of the outer cylindrical surface of the rotary valve in FIG. 10-1(A).

FIGS. 10A (2) and 10B (2) show schematic views illustrating a relationship between the intake passageway with the intake port under the maximum and minimum capacity condition, respectively, in the second embodiment.

Figure 9A:
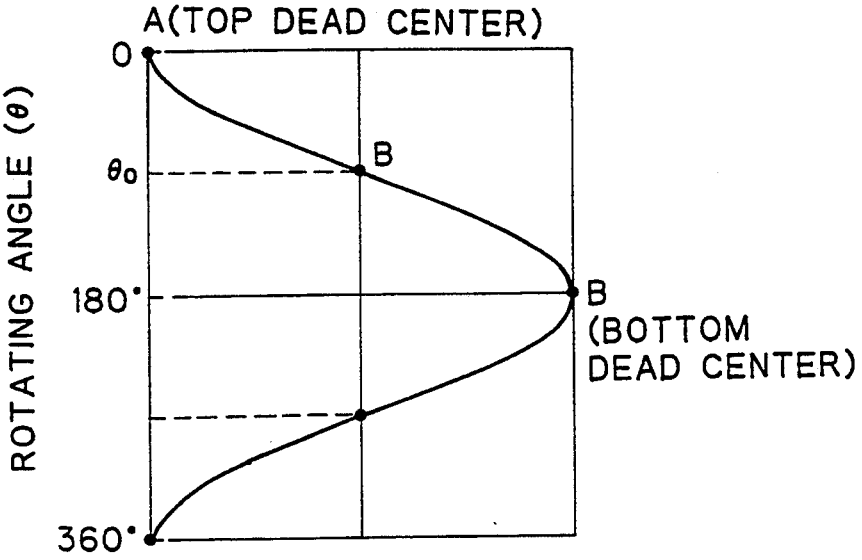
FIG. 9A shows a relationship between the rotating angle and the volume of a piston chamber of the compressor in the first embodiment of the present invention.
Figure 9B:
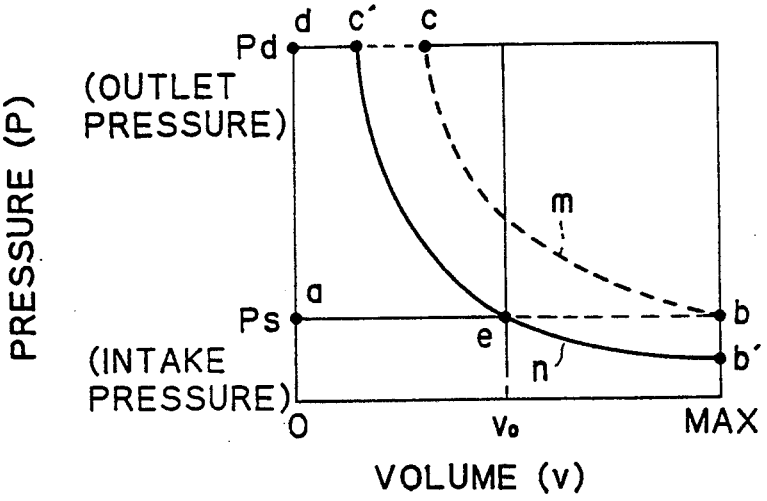
FIG. 9B shows a relationship between the volume of the piston chamber and the pressure therein.
Figure 11A:
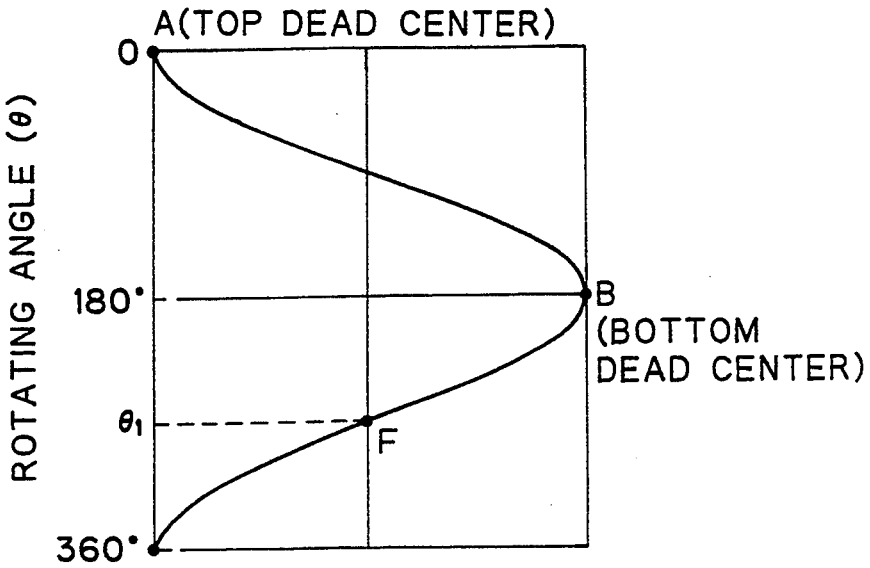
Figure 11B:
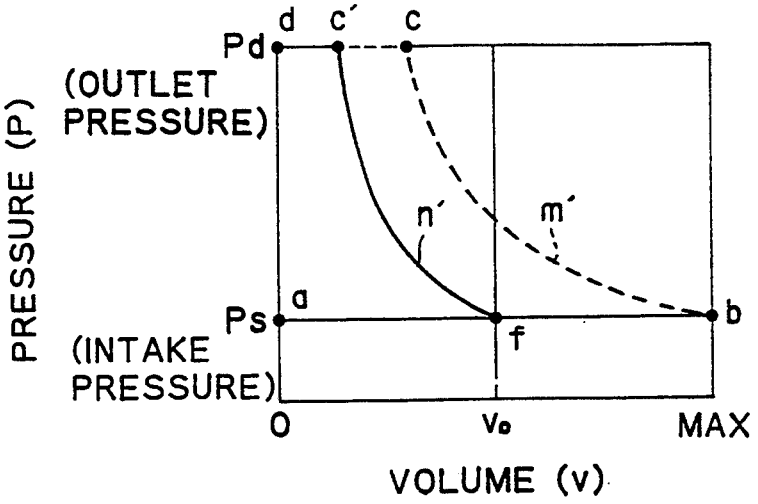

FIGS. 11A and 11B are similar to FIGS. 9A and 9B, but directed to the second embodiment of the compressor provided with the rotary valve as shown in FIG. 10.

Figure 1:
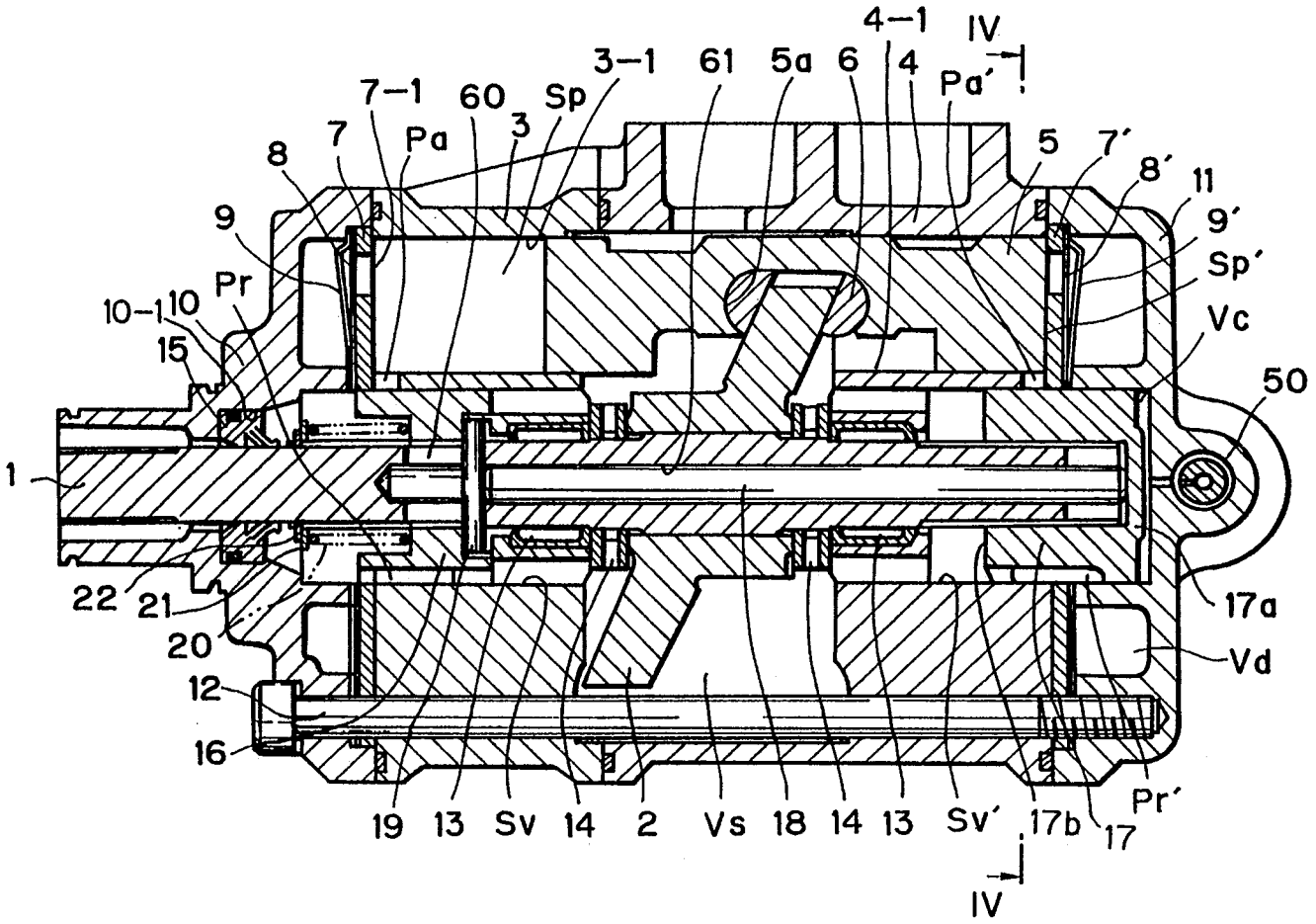
FIG. 1 is a longitudinal cross sectional view of a swash plate type compressor according to a first embodiment of the present invention when under minimum capacity conditions, taken along a line I—I in FIG. 4.
Figure 12:
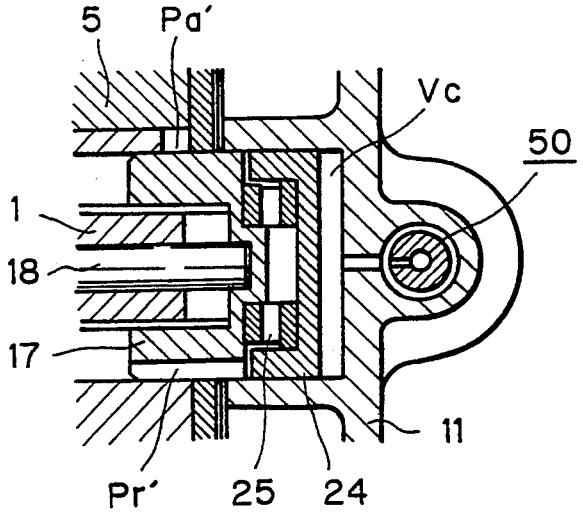

FIG. 12 shows a modification of a control valve in the first embodiment in FIG. 1.

Figure 13:
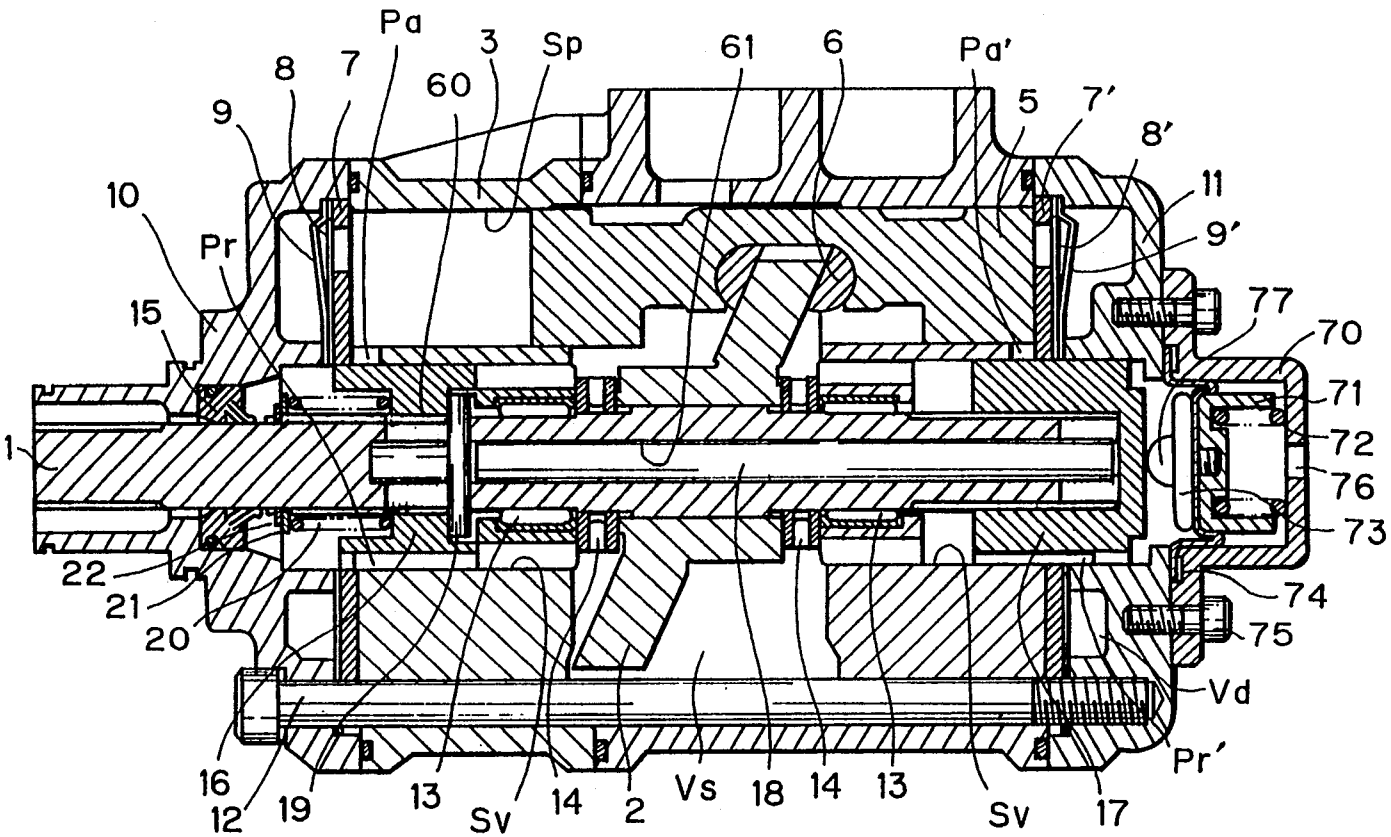

FIG. 13 shows a longitudinal cross sectional view of a swash plate type compressor according to the third embodiment of the present invention.

Figure 14:
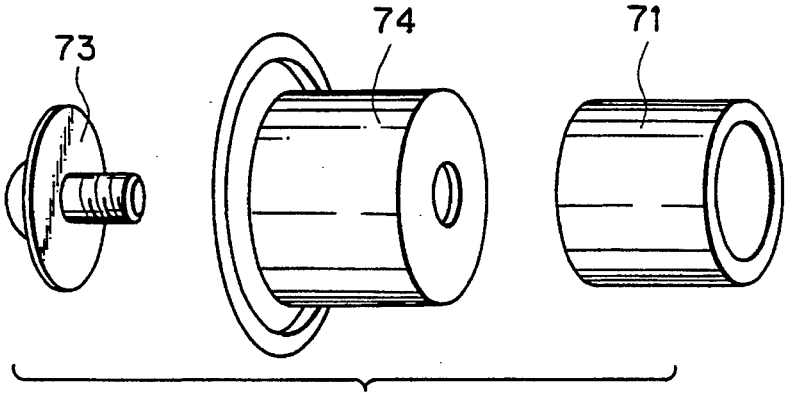

FIG. 14 is an enclosed perspective view of a control device in FIG. 13.

Figure 15:
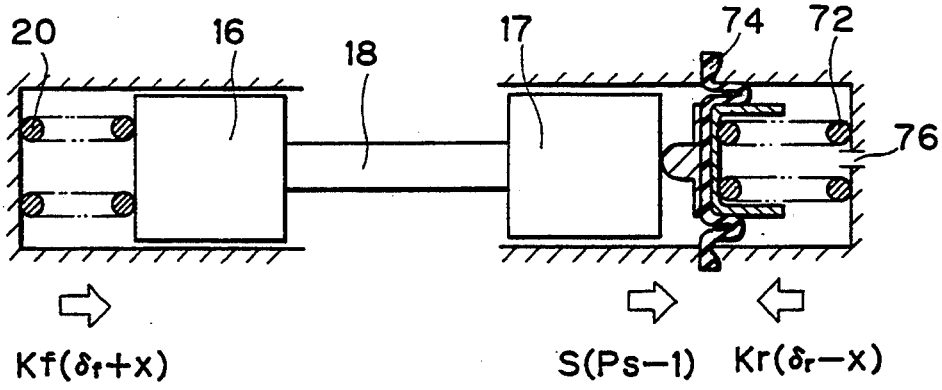

FIG. 15 is a diagrammatic view illustrating the operation of the embodiment in FIG. 13.

Figure 16:
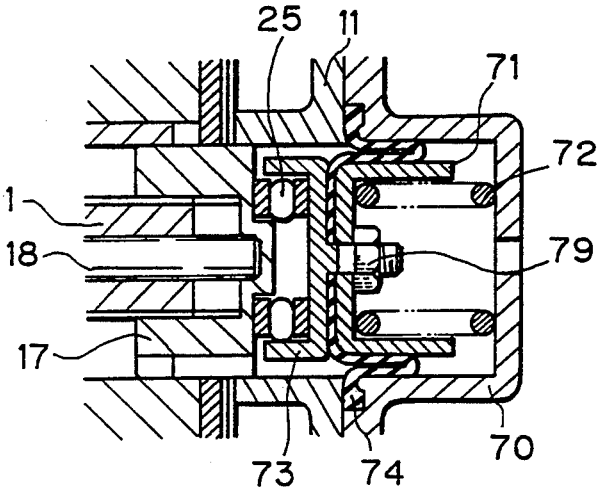
Figure 17:
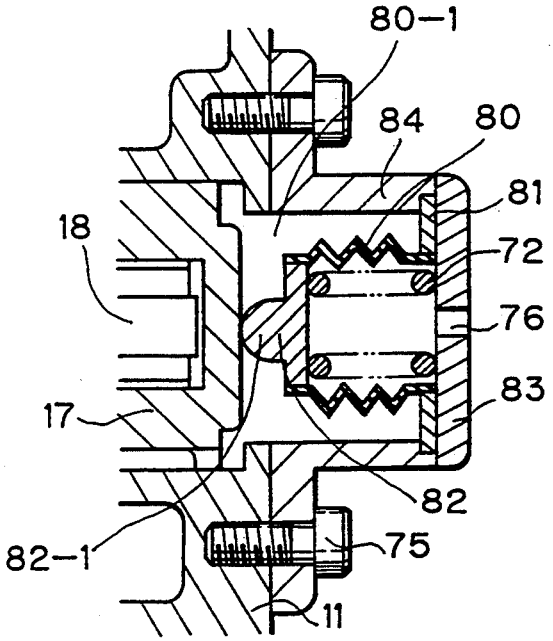

FIGS. 16 and 17 show modifications, respectively, of the control device.

Figure 18:
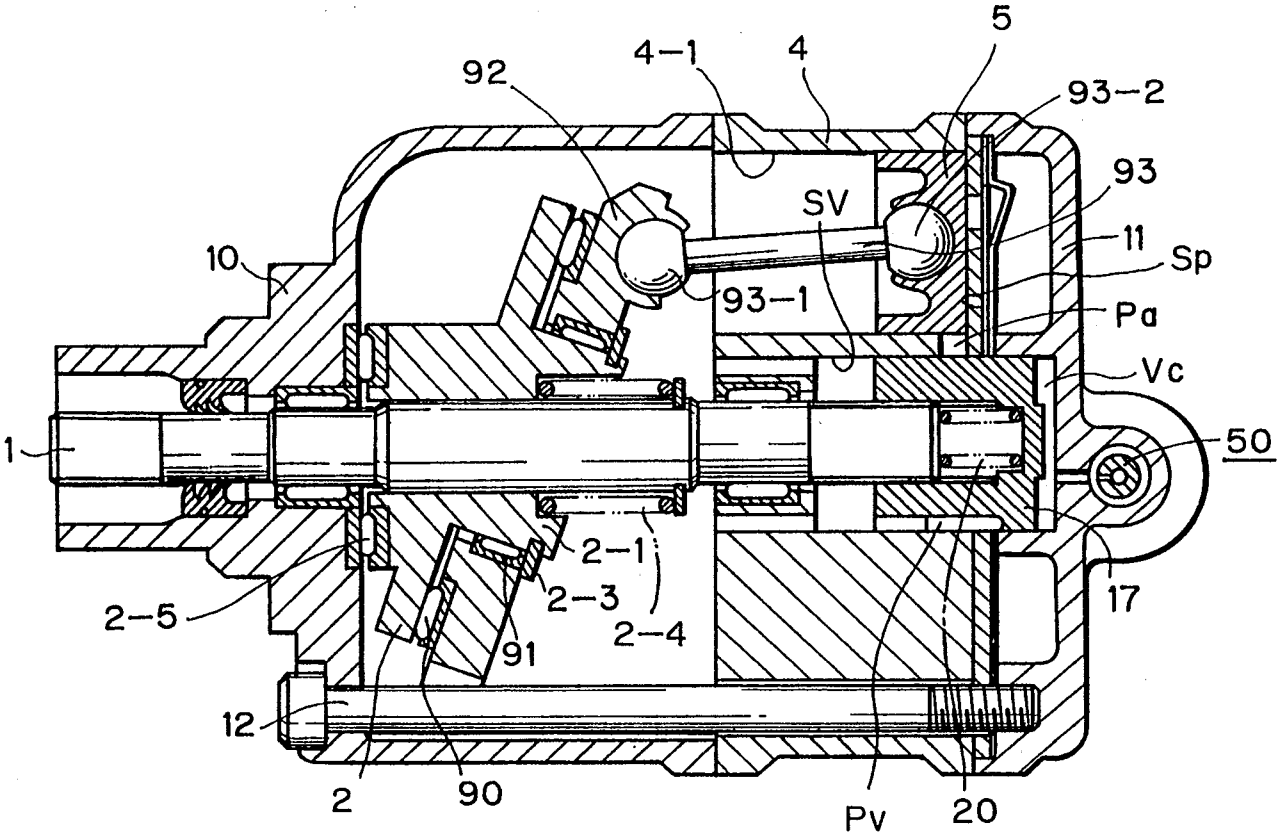

FIG. 18 shows a longitudinal cross sectional view of a swash plate type compressor according to a 5th embodiment of the present invention.

Figure 19:
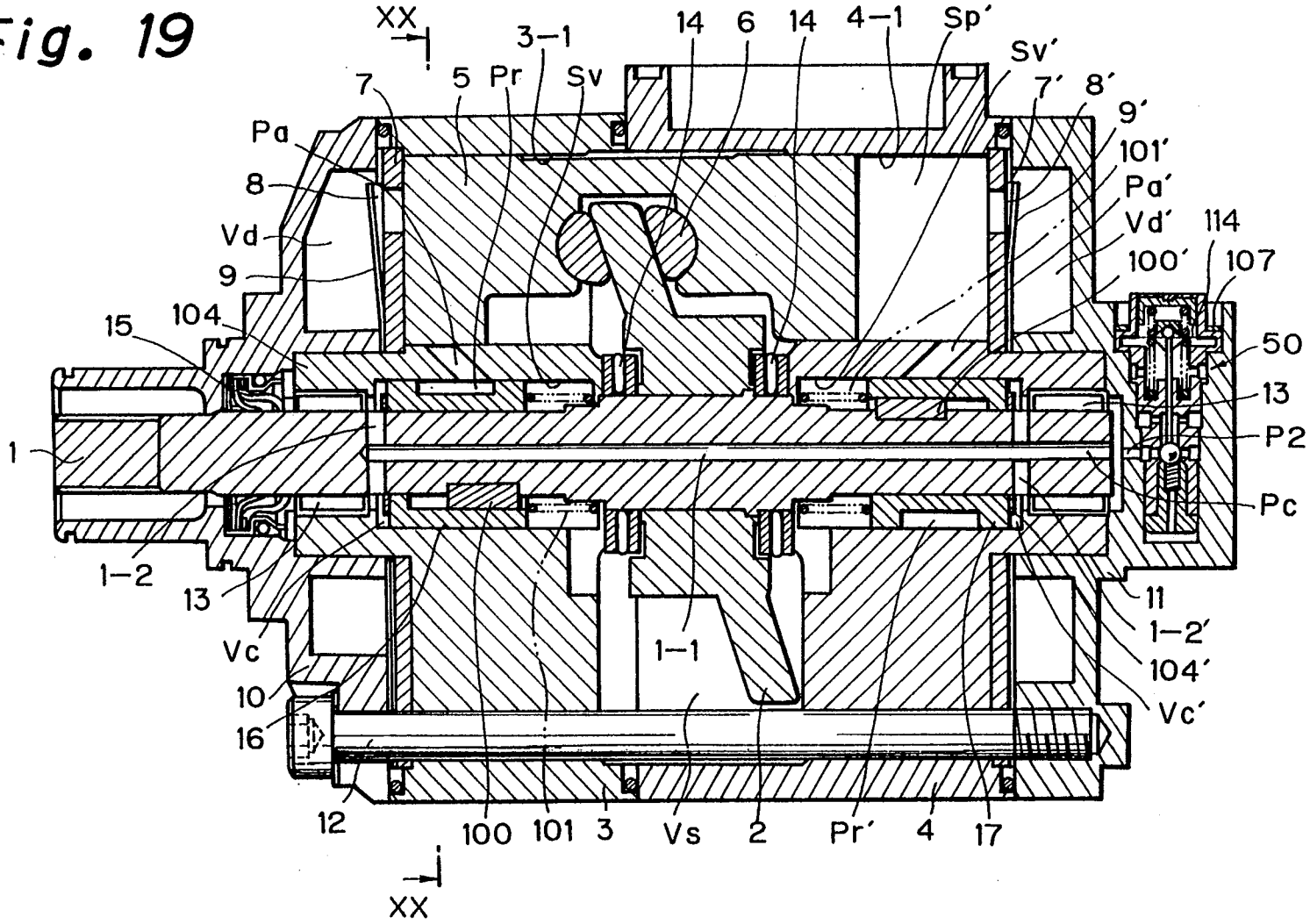
Figure 20:
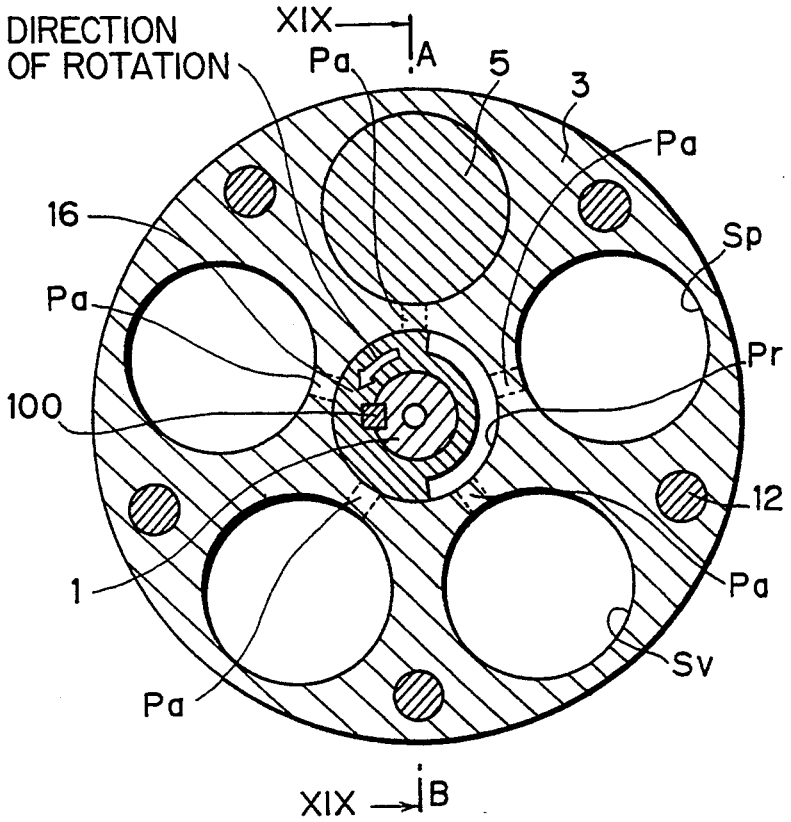

FIG. 19 shows a longitudinal cross sectional view of a swash plate type compressor according to a 6th embodiment of the present invention when under maximum capacity condition, taken along line XIX—XIX in FIG. 20.

FIG. 20 is a transverse cross sectional view taken along lines XX—XX in FIG. 19.

Figure 21:
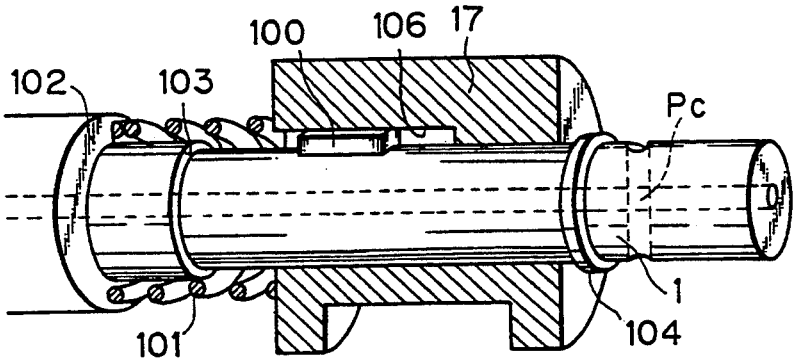

FIG. 21 is a schematic perspective view of a rotary valve in FIG. 19.

Figure 22:
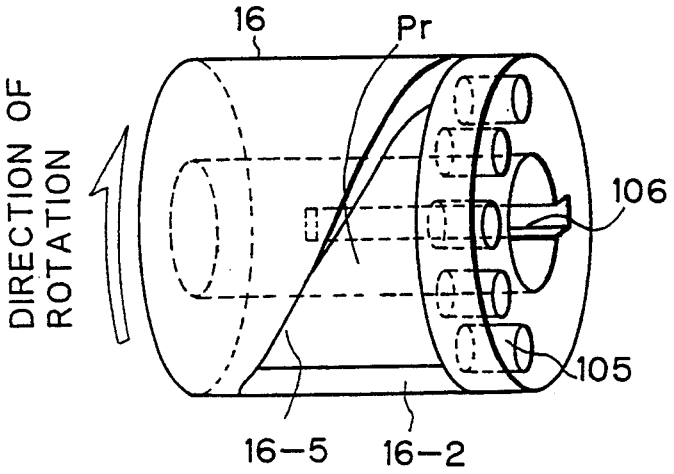
Figure 23:
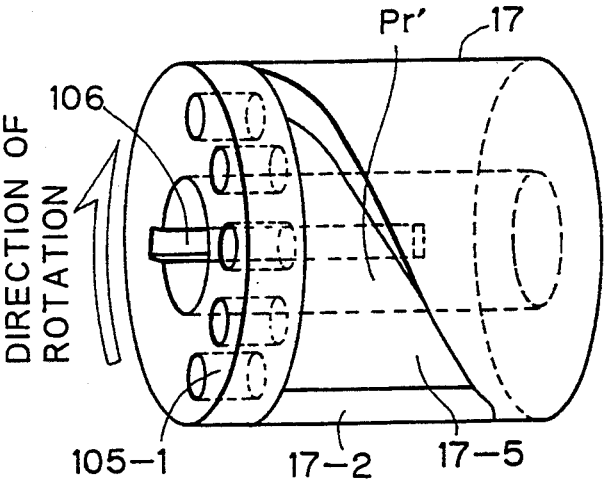

FIGS. 22 and 23 show rotary valves 16 and 17, respectively in the compressor in FIG. 19.

Figure 24:
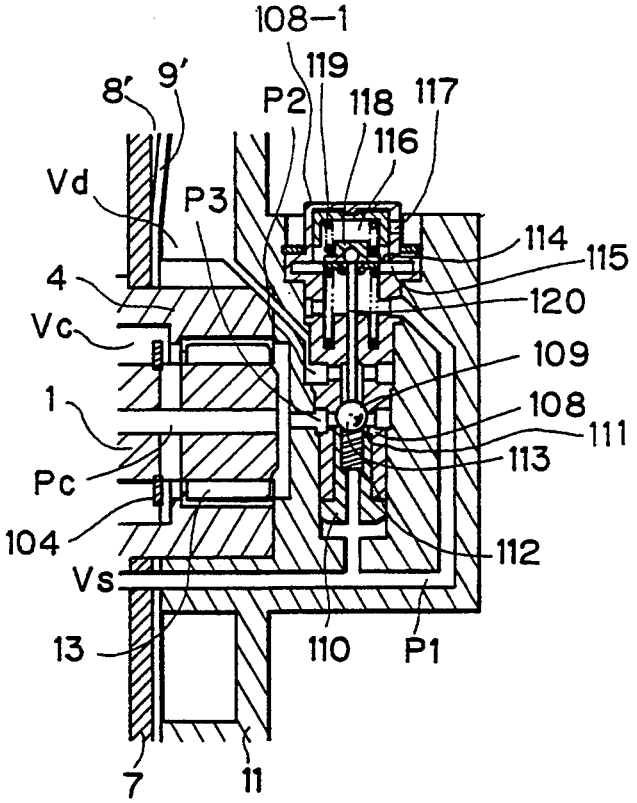

FIG. 24 shows a cross sectional view of the rotary valve in the compressor in FIG. 19.

Figure 25:
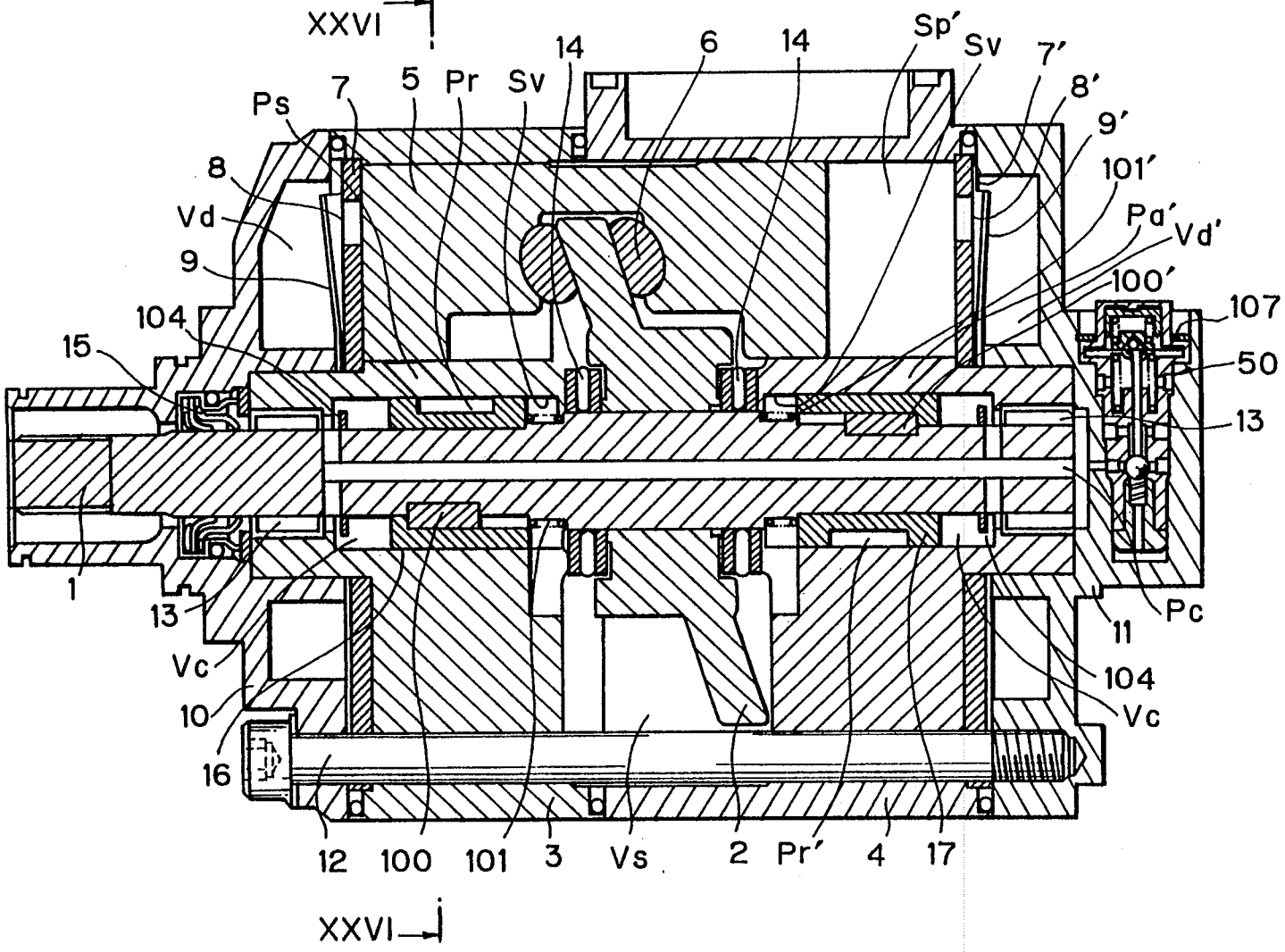
Figure 26:
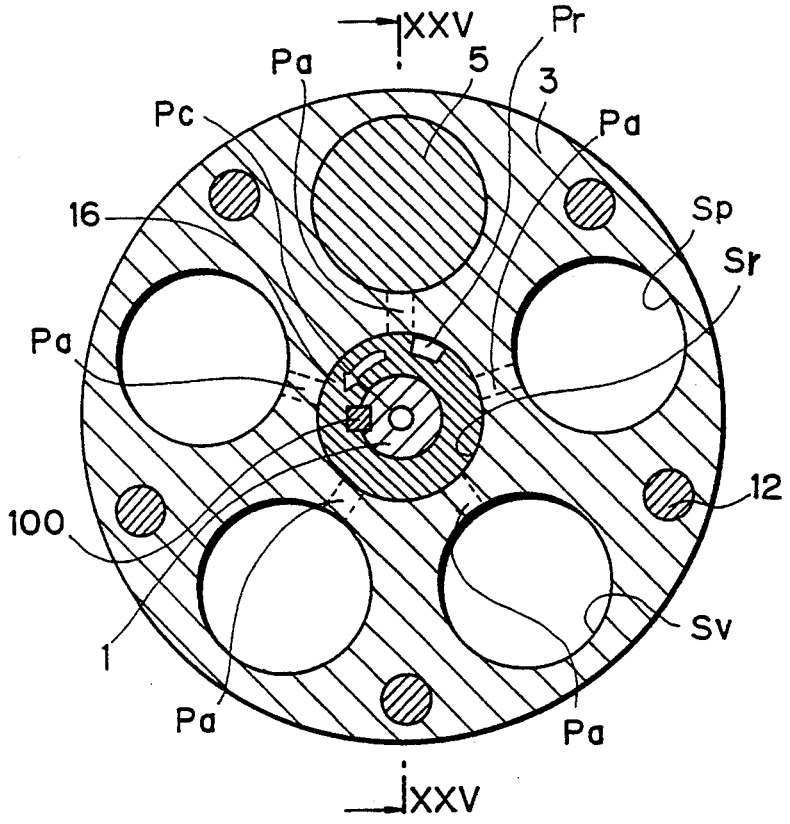

FIG. 25 is similar to FIG. 19, but when under minimum capacity conditions, taken along line XXV—XXV in FIG. 26.

FIG. 26 is a transverse cross sectional view taken along line XXVI—XXVI in FIG. 25.

Figure 27:
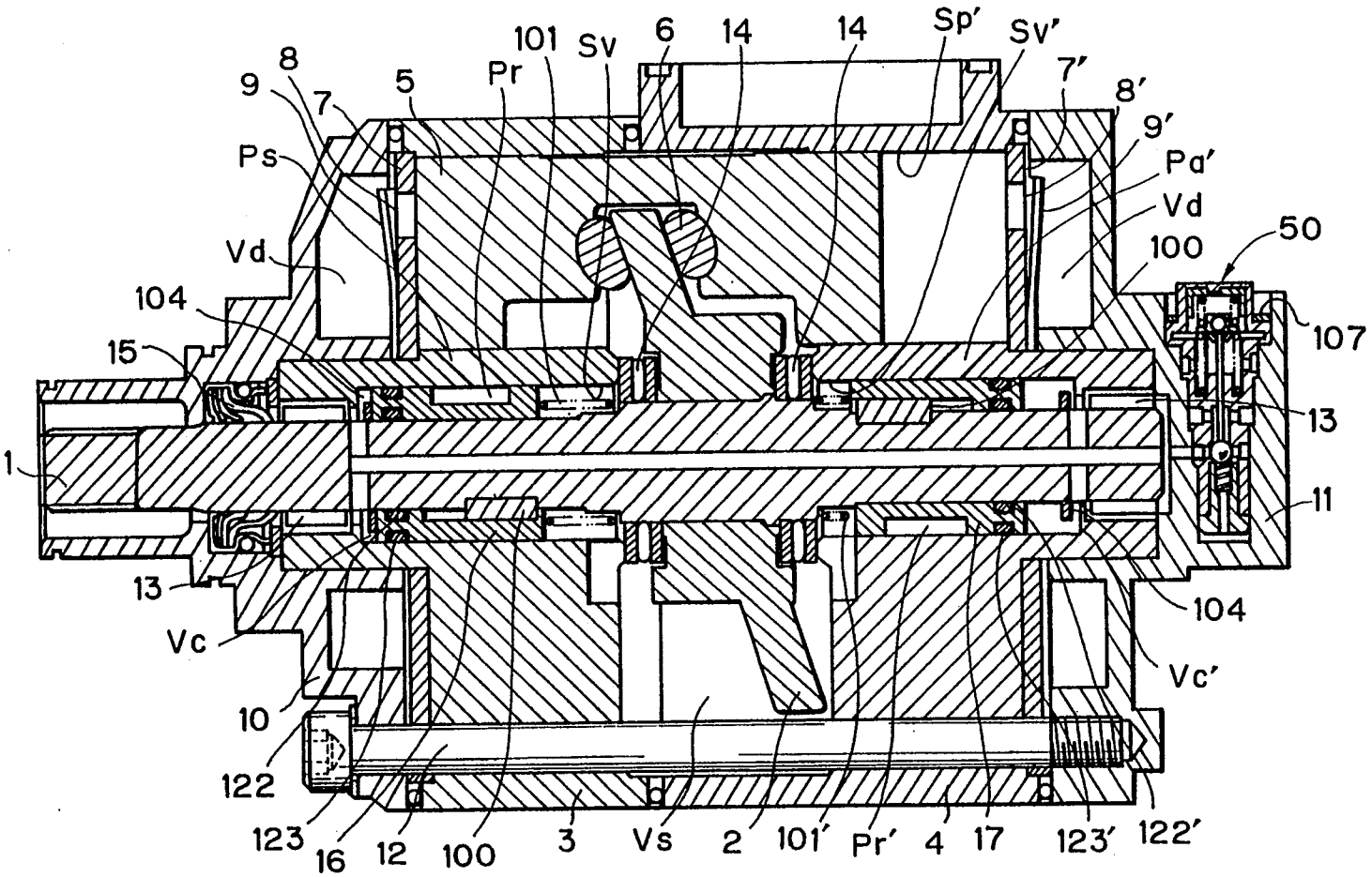
Figure 28:
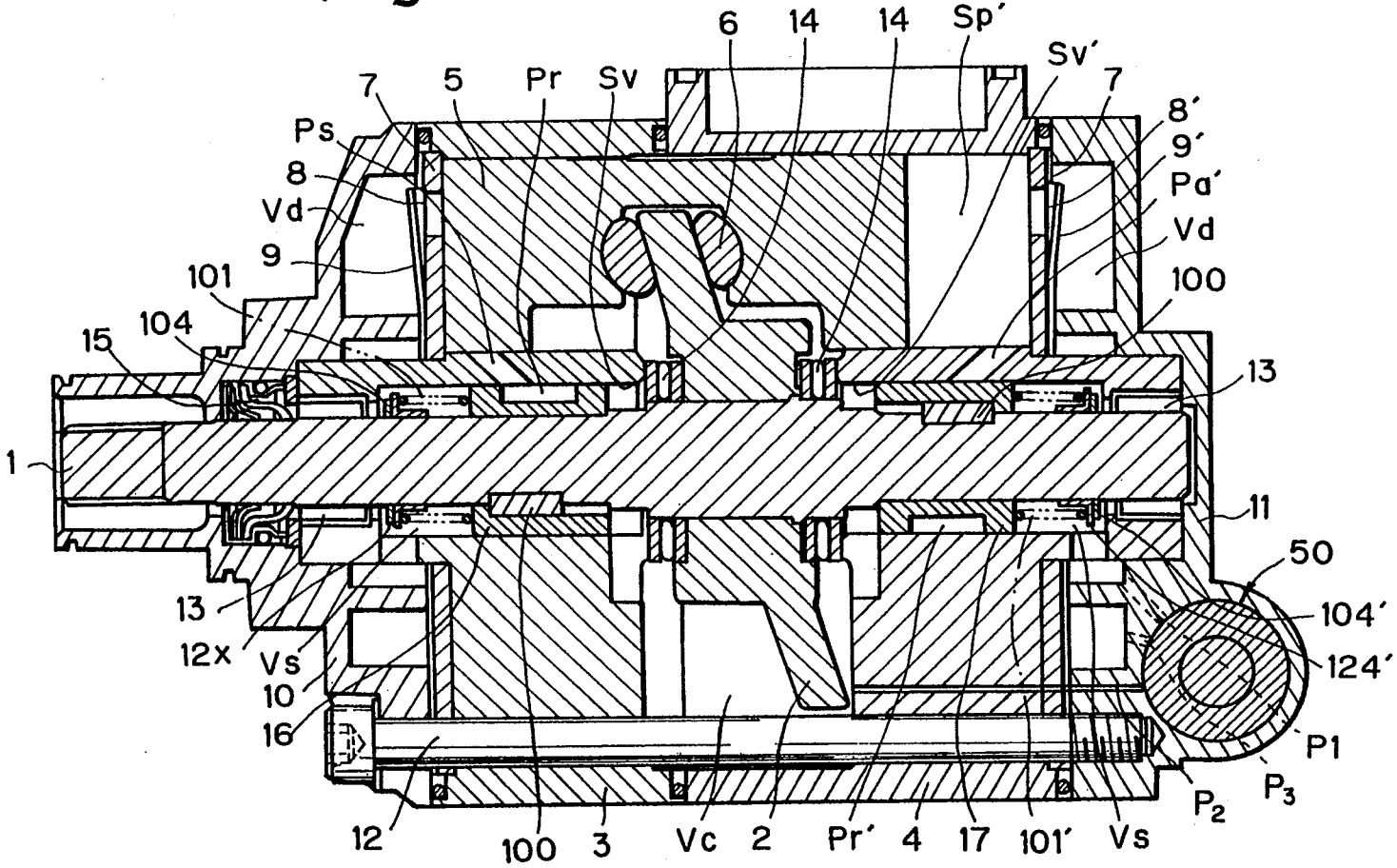
Figure 29:
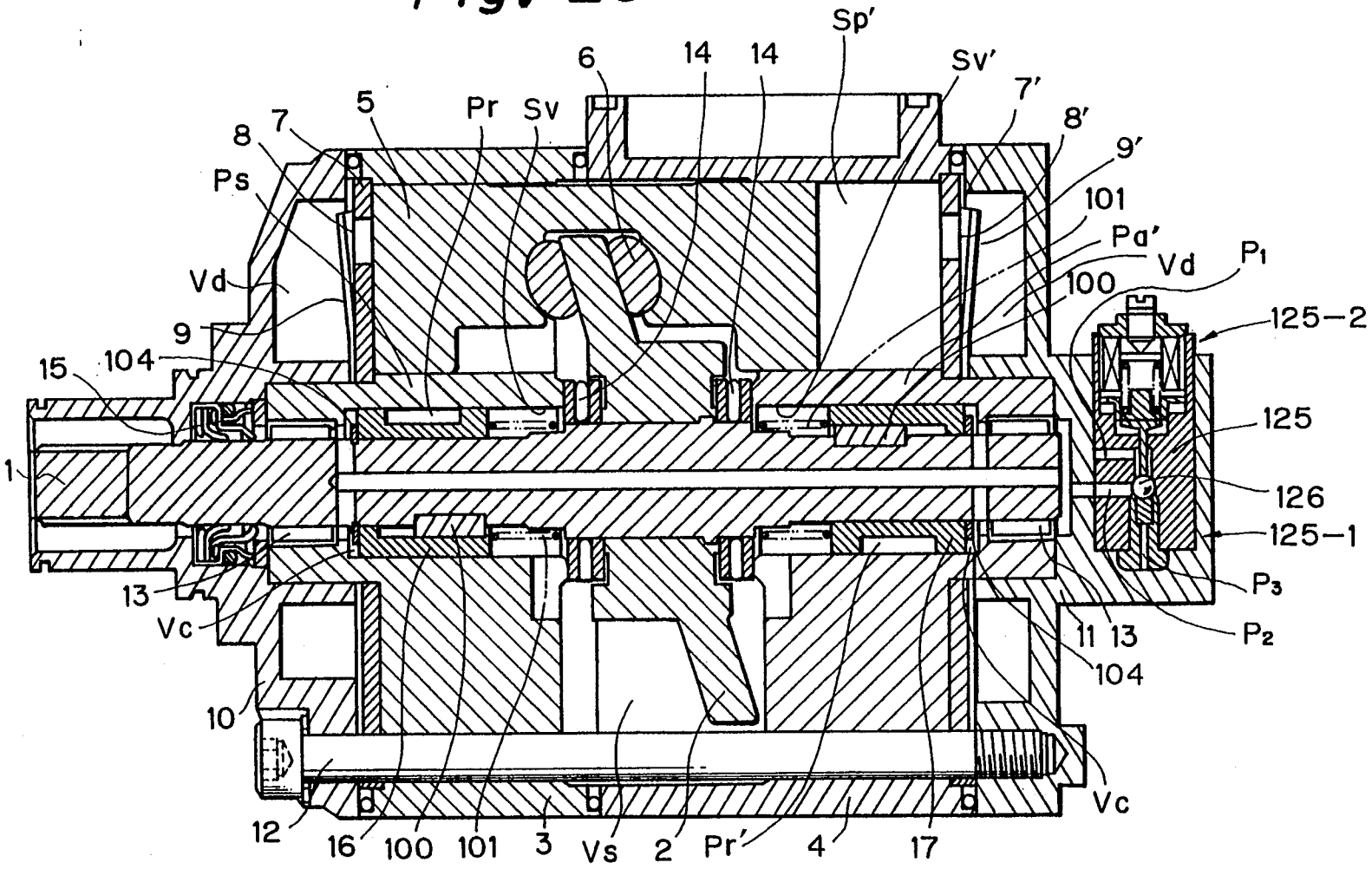

FIGS. 27, 28 and 29 show, respectively, longitudinal cross sectional views of swash plate type compressors for different embodiments.

Figure 30:
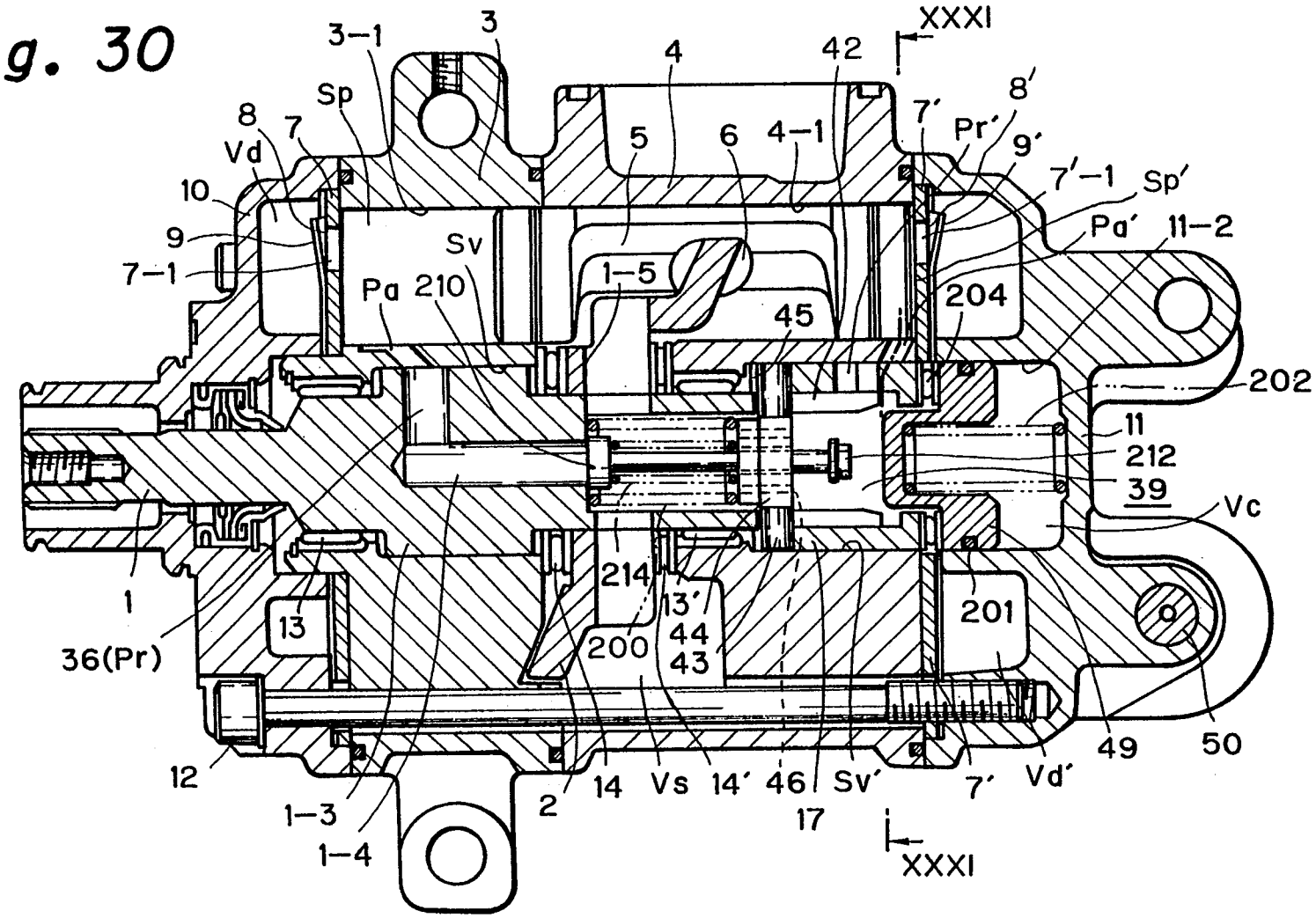
Figure 31:
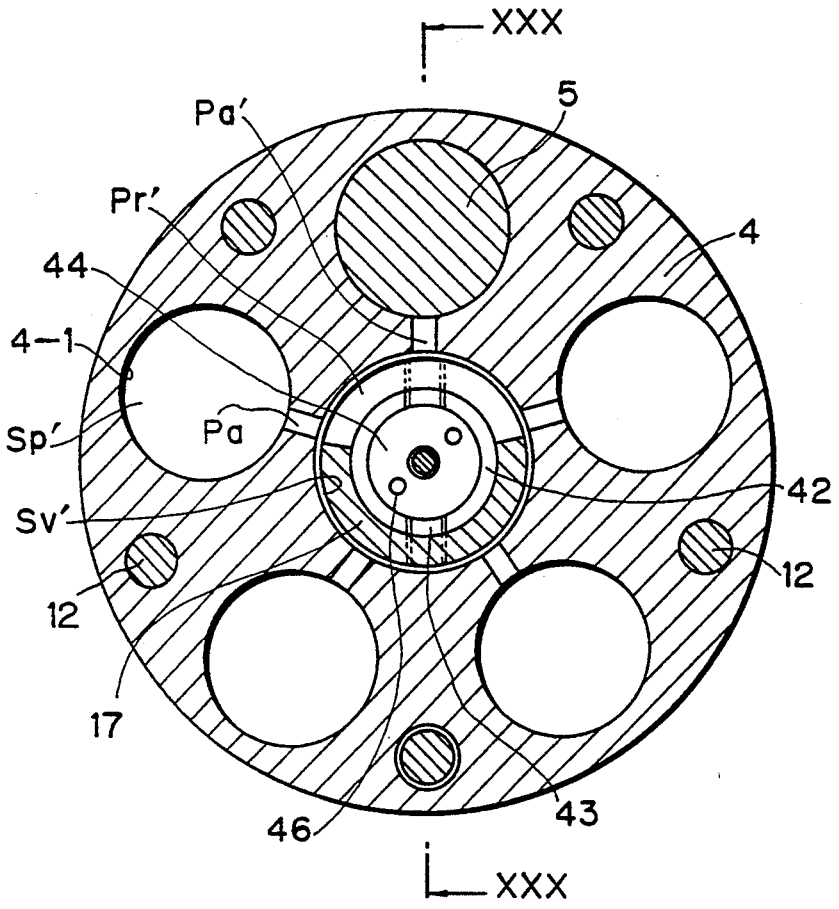

FIG. 30 is a longitudinal cross sectional view of a swash plate type compressor according to a 10th embodiment of the present invention, taken along line XXX—XXX in FIG. 31.

FIG. 31 is a transverse cross sectional view taken along line XXXI—XXXI in FIG. 30.

Figure 32:
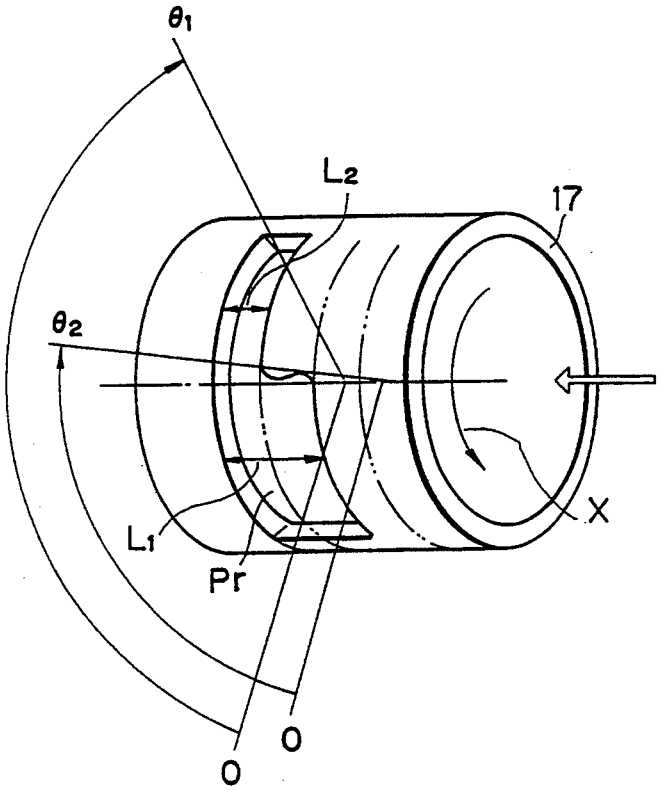

FIG. 32 shows a schematic perspective view of a rotary valve in the embodiment in FIG. 30.

Figure 33:
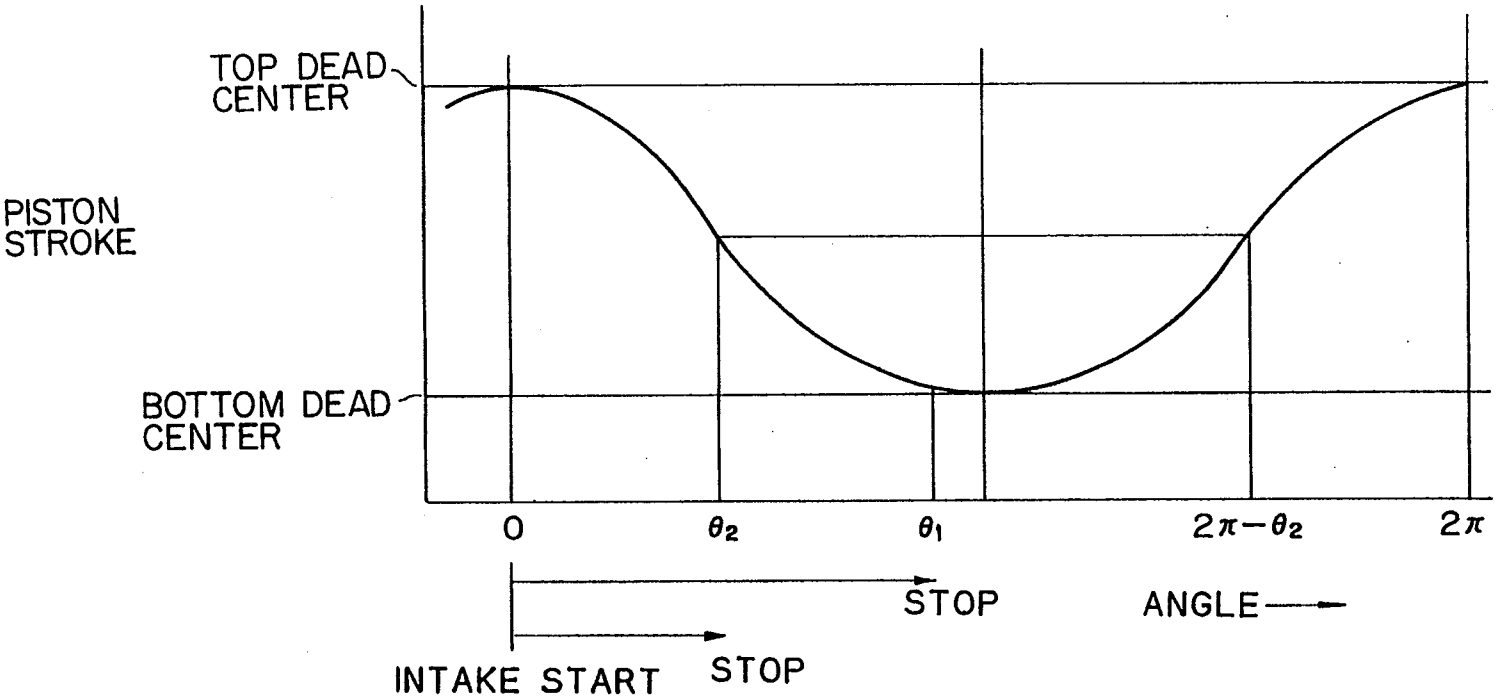

FIG. 33 shows a relationship between a rotating angle and a piston stroke in the embodiment in FIG. 30.

Figure 34:
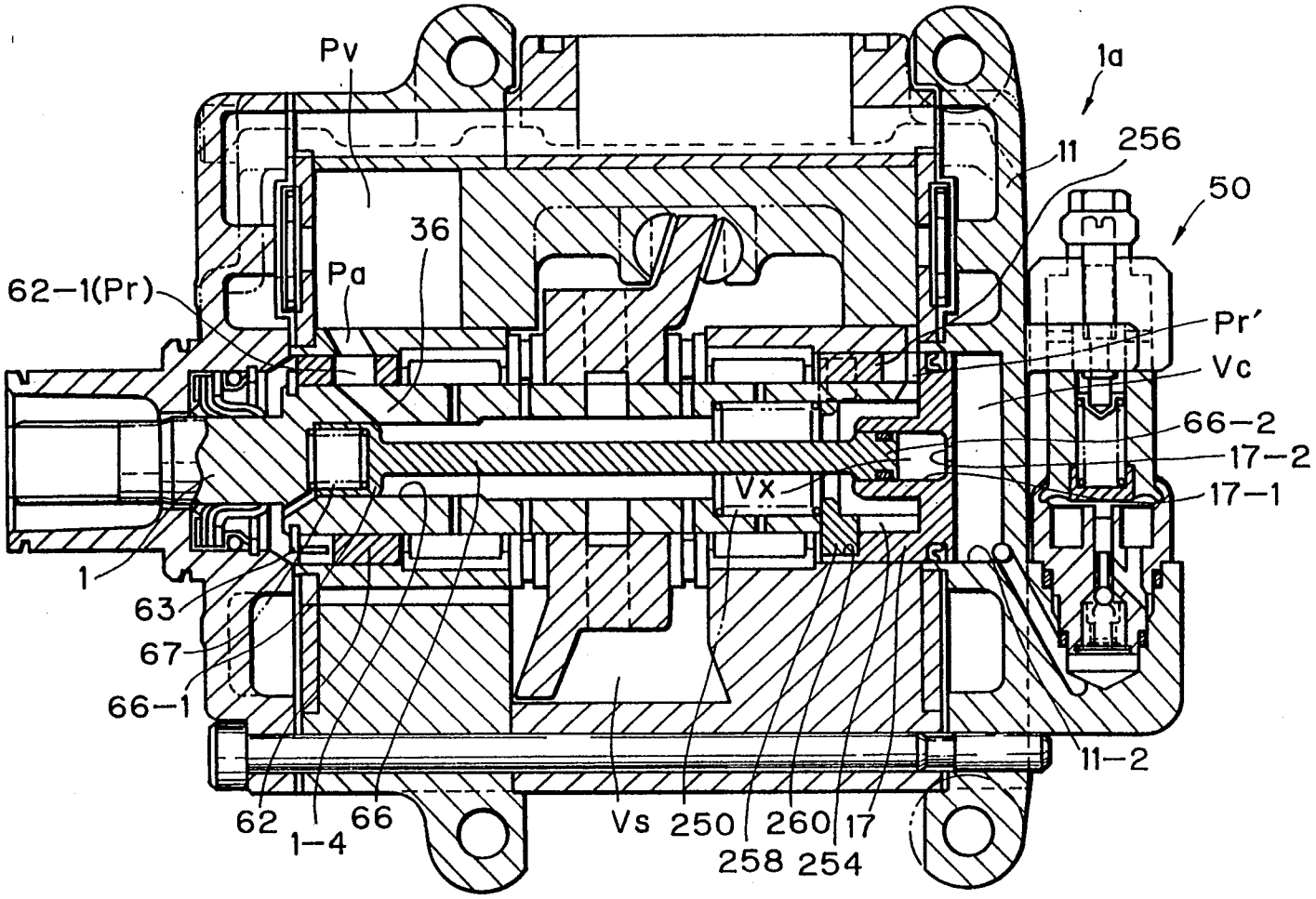

FIG. 34 is longitudinal cross sectional view of a swash plate type compressor according to a 11th embodiment of the present invention.

Figure 35:
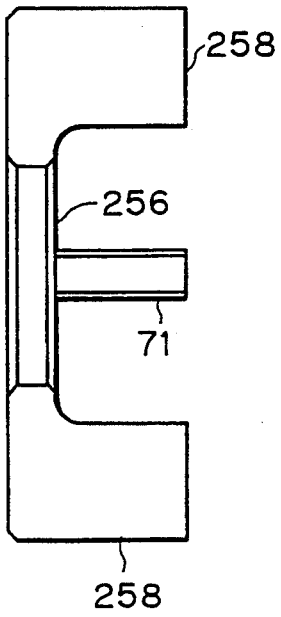

FIG. 35 is a side view of a stopper in the embodiment in FIG. 34.

Figure 36:
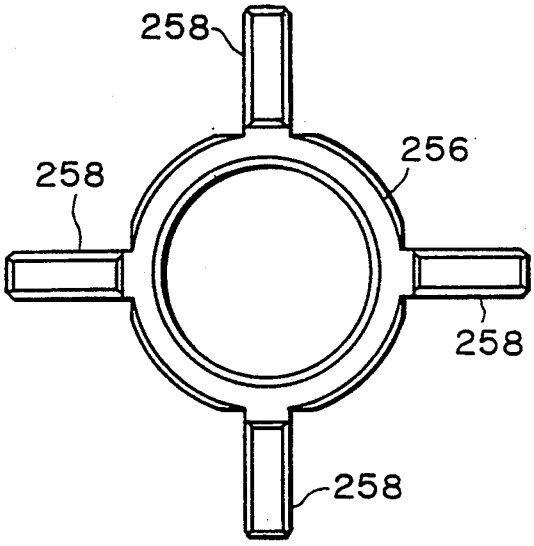

FIG. 36 is a front view of the stopper in FIG. 35.

Figure 37:
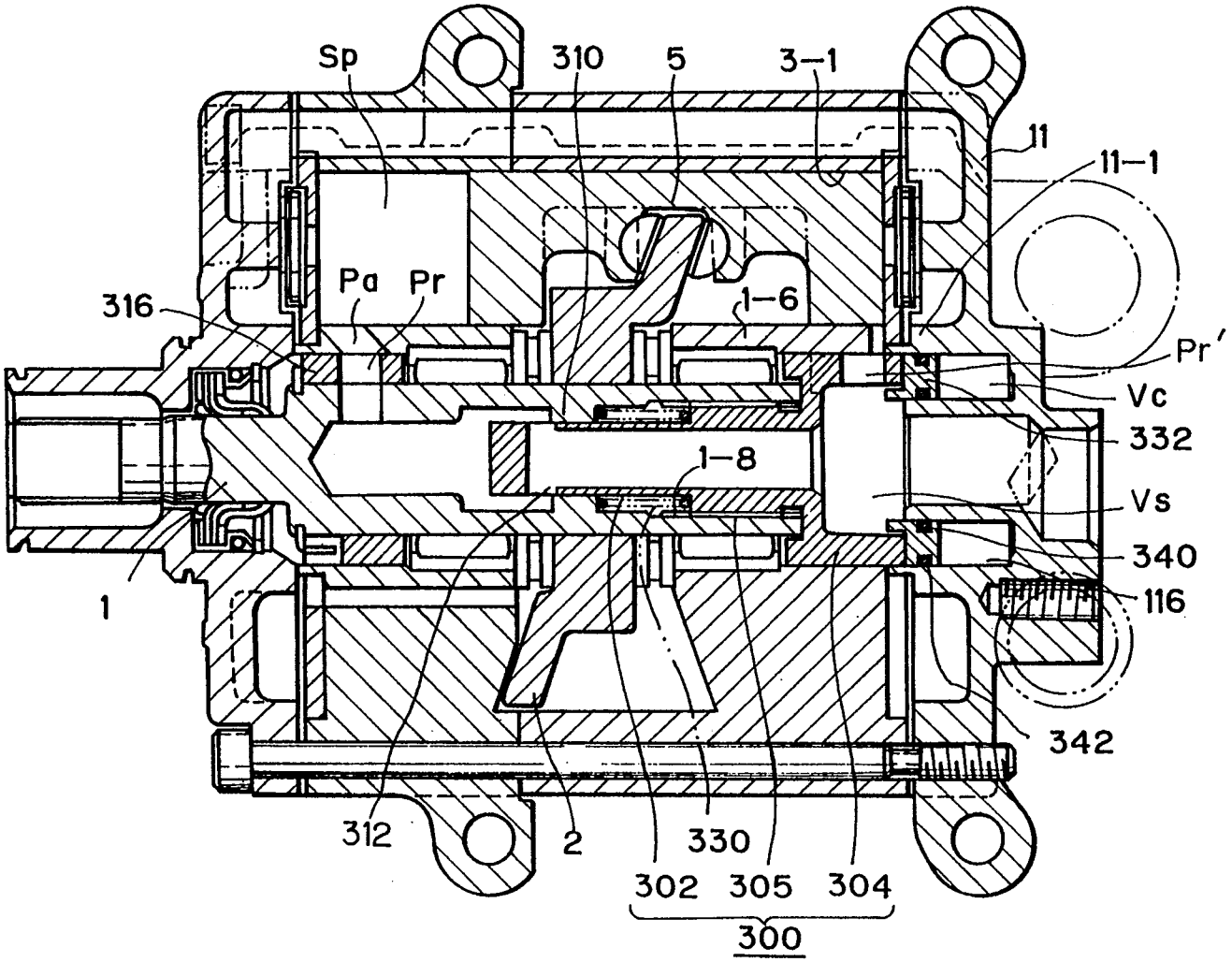

FIG. 37 is longitudinal cross sectional view of a swash plate type compressor according to a 12th embodiment of the present invention.

DESCRIPTION OF PREFERRED EMBODIMENT

Figure 4:
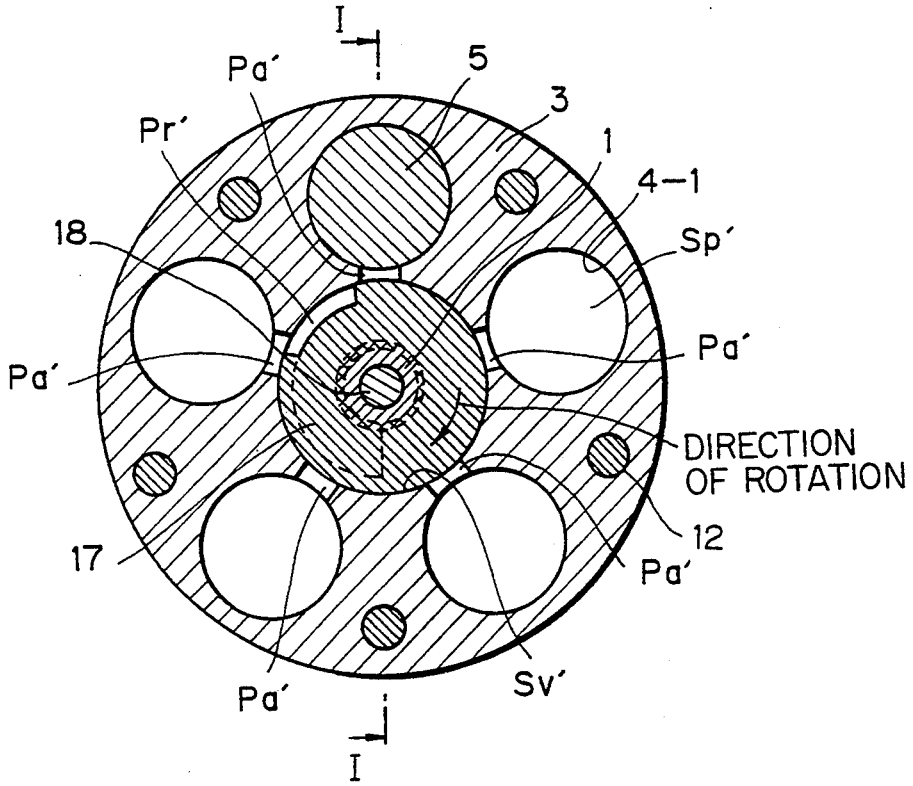
FIG. 4 is a transverse cross sectional view of the compressor, taken along line IV—IV in FIG. 1.

FIG. 1 shows a first embodiment of a swash plate type compressor according to the present invention that is used for a refrigerant compressor of an air conditioning apparatus in a vehicle. The compressor is provided with a rotating shaft 1 connected, via a electromagnetic clutch, (not shown) to a rotating shaft (not shown) of an internal combustion engine of the automobile for receiving a rotating movement therefrom. A swash plate 2 is fixedly connected to the rotating shaft 1. The compressor is further provided with axially separated cylinder blocks 3 and 4, which rotatably support the rotating shaft 1 by means of respective radial bearings 13 and thrust bearings 14. The cylinder blocks 3 and 4 define a plurality of axially spaced aligned sets of cylinder bores 3-1 and 4-1. The aligned sets are arranged equiangularly and spaced along the circumference of the cylinder blocks 3 and 4. See FIG. 4. Axially and slidably inserted in each aligned set of the cylinder bores is a double headed piston 5. Piston chambers Sp and Sp' are formed on the respective ends of the double headed piston 5 in the cylinder bores 3-1 and 4-1. The pistons 5 are connected, via respective pairs of shoes 6 having a semicircular cross sectional shape and received in recess 5*a* having a complimentary shape, to the swash plate 2, so that the rotational movement of the swash plate 2 by the rotation of the shaft 1 causes the pistons 5 to axially reciprocate in respective cylinder bores 3-1 and 4-1, so that the volume of the compression chamber Sp or Sp' alternately increases and decreases so as to compress the refrigerant, as will be fully described later. Connected to the ends of the cylinder blocks 3 spaced from the ends of the piston 5 are valve seats 7 defining valve ports 7-1 opened to respective compression chambers Sp. Arranged on a side surface of the valve seats 7 remote from the compression chambers Sp are delivery valves 8 which are used as reed valves for closing the respective valve ports 7-1. Arranged on one side of the delivery valves 9 are valve stoppers 9 for preventing the respective delivery valves 8 from buckling when the valves 8 are detached from the respective valve seat 7 due to high pressure in the compression chambers Sp during a compression stroke of the respective pistons 5. A similar construction including a valve seat 7', delivery valves 8' and a valve stopper 9' is provided for controling the outlet of the medium as compressed from the right handed piston chambers Sp'. The valve seats 7 and 7', the delivery valves 8 and 8' and valve stoppers 9 and 9' are sandwiched between the cylinder blocks 3 and a front casing 10 or a rear casing 11, and are tightened to each other by means of five bolts 12 that are circumferentially spaced as shown in FIG. 4, which shows top dead center at the top of the figure and bottom dead center at the bottom. In FIG. 1, the front casing 10 has a boss portion, inwardly of which, an annular recess 10-1 is formed. Arranged in the annular recess 10-1 is an annular seal assembly 15 that is in contact with an outer surface of the rotating shaft 1 during rotational movement, so that a sealing function is obtained between the seal assembly 15 and the shaft 1.

Figure 5:
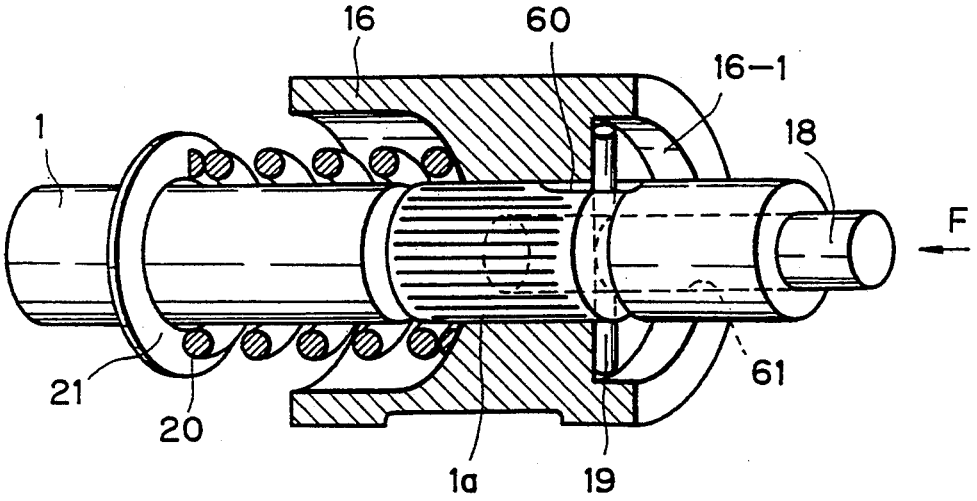
FIG. 5 is a schematic perspective view illustrating the front rotary valve in FIG. 1.

A pair of axially spaced rotary valves 16 and 17 are arranged on the rotating shaft 1 at its front and rear portions, respectively. The rotary valves 16 and 17 are spline engaged to the shaft 1 so that they rotate together with the rotation of the shaft 1 while slidably moving thereto. A reference numeral 20 denotes a coil spring arranged around the shaft 1 and located between a collar 21 connected onto the shaft 1 by means of a circlip 22 and the front rotary valve 16 for urging the front rotary valve 16 in a right-hand or rearward direction in FIG. 1. Arranged between the front rotary valve 16 and the rear rotary valve 17 is a guide pin 19 and a push rod 18. The shaft 1 is formed with diametrically opposite slits 60 to which the guide pin 19 extends radially so that the guide pin 19 is axially movable with respect to the shaft 1. The push rod 18 is axially and slidably inserted to an axial bore 61 of the shaft 1. As shown in FIG. 5, the front rotary valve 16 forms, at its axial end facing the rear rotary valve 17, an annular recess 16-1, to which the ends of the guide pin 19 extend. As a result, an axial movement of the rear rotary valve 17 toward the front rotary valve 16, as shown by an arrow F, causes the front rotary valve 16 to move in the same direction the same distance via the push rod 18 and the guide pin 19 against the force of the spring 20. It should be noted that, in FIG. 5, the shaft 1 has, on its outer surface, a spline portion 1*a* that is spring engaged with a spline inner surface of a central bore of the rotary valve 16.

Figure 2A:
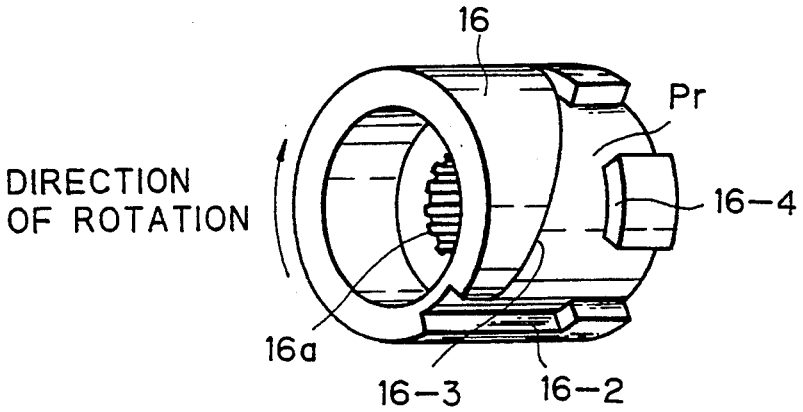
FIGS. 2A and 2B show perspective views of rotary valve 16 and 17, respectively in FIG. 1.

As shown in FIG. 2A, the rotary valve 16 forms a tubular body, which defines inner spline 16*a* in a spline engagement with the outer spline 1*a* (FIG. 5) on the shaft 1. The rotary valve 16 forms, on its outer cylindrical surface, a circumferentially extending recess having a gradually increasing axial width, defining an intake passageway Pr having a substantially triangle shape when developed. The recess Pr, thus forms an edge 16-2 extending parallel along the axis of the shaft 1, a front edge 16-3 inclined and a rear edge 16-4 extending circumferentially. The rear edge 16-4 has portions cut out for communication with the intake chamber Vs. Similarly, as shown in FIG. 2-(B), the rotary valve 17 forms a tubular body that defines inner spline 17*a* in spline engagement with the outer spline on the shaft 1. The rotary valve 17 forms, on its outer end 3, a circumferentially extending recess having a gradually increasing axial width and defining an intake passageway Pr having a substantially triangle shape when developed. The recess Pr', thus forms an edge 17-2 extending parallel along the axis of the shaft 1, a front edge 17-3 circumferentially inclined and a rear edge 17-4 extending circumferentially. These intake passageways Pr and Pr' are opened to an intake pressure chamber Vs formed in the compressor, so that the intake passageway Pr and Pr' are always under the same pressure level. The intake pressure chamber Vs is in communication with the source of a fluid medium, such as a refrigerant, to be compressed. The arrangement of the rotary valves 16 and 17 with respect to the rotating shaft 1 is such that, upon assuming an angular position of the rotating shaft upon one complete rotation, the axially extending wide edges 16-2 and 17-2 of the rotary valves 16 and 17 engage with grooves Pa, as will be described later, and the corresponding piston 5 is at top dead center. Namely, the front rotary valve 16 and the rear rotary valve 17 are located on angular positions of the shaft 1, the phase difference of which are 180 degrees. As shown in FIG. 1, the rear rotary valve 17 has a closed rear portion 17*a* and is inserted to a valve bore Sv' so that a control pressure chamber Vc is formed on one side of the second or rear rotary valve 17 so that the control pressure in the chamber Vc causes the second rotary valve 17 and the first, front rotary valve 16 to move on the shaft 1 against the force of the spring 20. Namely, the front and second rotary valves 16 and 17 move in unison via the push rod 18 and the guide pin 19.

The cylinder blocks 3 and 4 form, at their center portions, valve cylinders Sv and Sv', in which the rotary valves 16 and 17 rotate, respectively, while small gaps are maintained between the respective cylinders and the rotary valves. These valve bores Sv and Sv' are in communication with the piston chambers Sp and Sp' via the cut grooves Pa and Pa, respectively, which are formed at ends of the cylinder blocks 3 and 4 adjacent to the valve seats 7, and 7' as shown in FIGS. 1 and 4. An arrangement of the cut grooves Pa and Pa' and the variable intake passageways Pr and Pr' are such that the intake passageway Pr or Pr' having a developed triangle shape is, during one rotation of the rotary valve 16 or 17, in communication with a single cylinder Sp or Sp' via the cut groove Pa or Pa' at a specified range of a rotating angle during one complete rotation of the rotary valve 16 or 17. Namely, during rotation of the rotary valves 16 and 17, communications between the variable intake passageway Pr and Pr' and the piston cylinders Sp and Sp', which are circumferentially spaced via the respective cut grooves, takes place in a sequential manner along the circumferential direction, as will be seen from FIG. 4.

Figure 6:
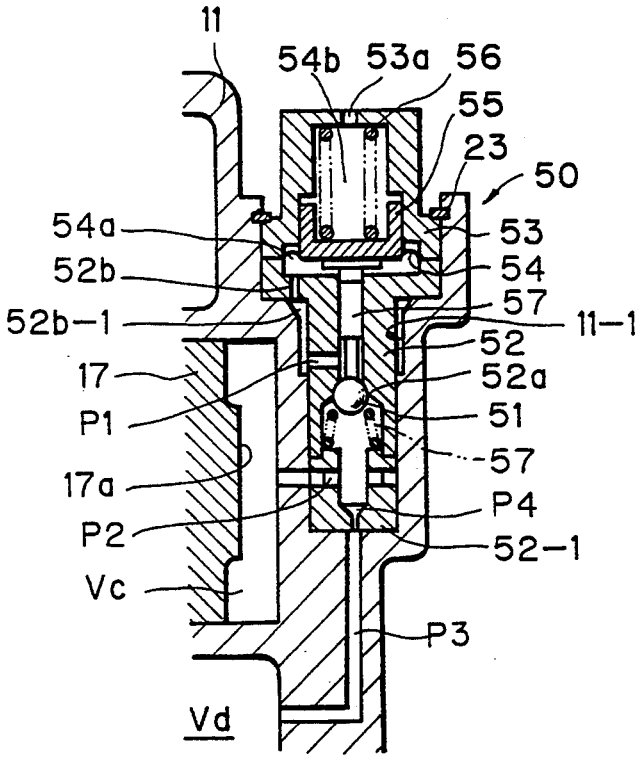
FIG. 6 is a longitudinal cross sectional view of the control valve in the compressor in FIG. 1.

A control valve 50 is, as shown in FIG. 6, arranged in the rear casing 11 so that it extends in a direction transverse to the axis of the rotation of the shaft 1. The rear casing 11 is formed with an outwardly opened bore 11-1 with a shoulder, to which the valve 50 is fitted, and fixed to the casing 11 by means of a circlip 23. The control valve 50 as a three port valve includes an upper cover 53 and a housing 52, which defines a first or intake pressure port $P_1$, a second or control pressure port $P_2$ and a third or outlet pressure port $P_3$. The intake pressure port $P_1$ is connected to the intake pressure chamber Vs in the compressor; the control pressure port $P_2$ is connected to the control pressure chamber Vc in the compressor, and the outlet pressure port $P_3$ is connected to the outlet pressure chamber Vd. Arranged in the housing 52 is a ball valve 51, which rests on a conical shaped valve seat 52*a* formed in the housing 52 for controlling communication between the intake pressure port $P_1$ and the control pressure port $P_2$. A coil spring 57 is provided for urging the ball valve 51 so that the ball valve 51 is seated on the valve seat 52*a*. A diaphragm 54 is provided so that it is, at its outer peripheral portion, sandwiched between the top cover 53 and the lower housing 52. A cap shaped stopper 55 is vertically and slidably fitted to an inner bore of the cover 53, and a coil spring 56 is provided for urging the stopper 55 downward. The diaphragm 54 is also connected to the bottom end of the stopper 55, and facing the bottom end of the piston 55 is a rod 57 that is slidable in a vertical bore of the housing 52, and extends vertically so that the rod 57 faces the upper surface of the ball 51. Formed on the bottom side of the diaphragm 54 is a first space 54*a* that is in communication with the intake pressure port $P_1$ via an orifice 52*b* and an annular space 52*b*-1. Formed on the upper side of the diaphragm 54 is a second space 54*b* that is opened to the outside air via an opening 53*b*. As a result, a displacement of the diaphragm 54 occurs in accordance with a difference between a fluid force, as generated by a pressure difference between the intake pressure in the first chamber 54*a* and the atmospheric pressure in the second chamber 54*b*, and the spring force as generated by the spring 56 arranged in the chamber 54*b* opened to the outside air. The rod 57 is for transmission of the displacement of the diaphragm 54 to the ball 51. It should be noted that an orifice $P_4$ having a small inner diameter is formed in a lower separated portion 52-1 of the housing 52 so that the control pressure port $P_2$ is always in communication with the outlet pressure port $P_3$ via the throttle portion $P_4$ for controlling the introduction of outlet pressure.

Now, an operation of the swash plate type compressor according to the first embodiment of the present invention will be explained. Upon a rotation of the rotating shaft 1, the swash plate 2 integrally connected thereto is also rotated. The rotational movement of the swash plate 2 causes the pistons 5 to be axially reciprocated in the respective cylinder bores 3-1 and 4-1 between top dead center and bottom dead center due to the fact that the swash plate 2 is connected to the pistons 5 via respective pairs of shoes 6. At the same time, the rotary valves 16 and 17 in spline engagement with the shaft 1 are rotated in the valve cylinder Sv and Sv', respectively. In this case, the variable intake passageways Pr and Pr' formed on the outer peripheries of the rotary valves 16 and 17 are always subject to intake pressure, so that the piston chambers Sp or Sp' in communication with the intake passageway Pr or Pr' via the cut groove Pa or Pa' are maintained under conditions. Note: in FIG. 1, top dead center references to a position of the piston 5 where the piston 5 is closest to the valve plate 7 or 7', thereby ousting the smallest possible piston chamber volume, and bottom dead center refers to a position of the piston such that the piston is farthest from the valve plate 7, thereby creating the maximum piston chamber volume. FIGS. 4, 8, 20 and 26 are referenced with top dead center of the piston at the top of the respective figure and bottom dead center being at the bottom.

In the swash plate type variable volume compressor according to the present invention, the variable intake passageway Pr or Pr' is in communication with the specific cut groove Pa or Pa' associated with the corresponding piston cylinder Sp or Sp' in the respective, particular angular range in one complete rotation between a position just after top dead center and a position before reaching bottom dead center, of the corresponding piston 5. The refrigerant gas in the intake pressure chamber Vs is admitted into the cylinder Sp or Sp' at a rotating angle of the rotary valve 16 or 17, where the intake passageway Pr or Pr' communicates with the corresponding intake port Pa or Pa'. The rotational movement of the rotary valve 16 or 17 causes its rotational angle to be outside of the above range of the rotating angle, so that the piston cylinder Sp or Sp' and the corresponding cut groove Pa or Pa' are disconnected from the variable intake passageway Pr or Pr' of the rotary valve 16 or 17. A value of the volume of the compressor corresponds, therefore, to this amount of refrigerant gas confined in the piston cylinder Sp or Sp' at the instant just when the variable intake passageway Pr or Pr' of the rotary valve 16 or 17 is disconnected from the cut groove Pa or Pa' associated with the corresponding piston cylinder Sp or Sp'.

FIGS. 1 and 4 show conditions such that the rotary valves 16 and 17 are moved to respective, most right side (rearward) positions. Under these conditions, the minimum value of the rotating angle of about 25 degrees from an angular position at top dead center is obtained, where the variable intake passageway Pr or Pr' is in communication with the piston cylinder Sp or Sp'. Namely, the rotary valves 16 and 17 are in the respective axial positions where the corresponding variable intake passageways Pr and Pr' are in communication with the respective cut grooves Pa and Pa' at only a small range of the rotating angle. As a result, intake volume of about 20% with respect to the maximum intake volume of the refrigerant gas is obtained.

Figure 7:
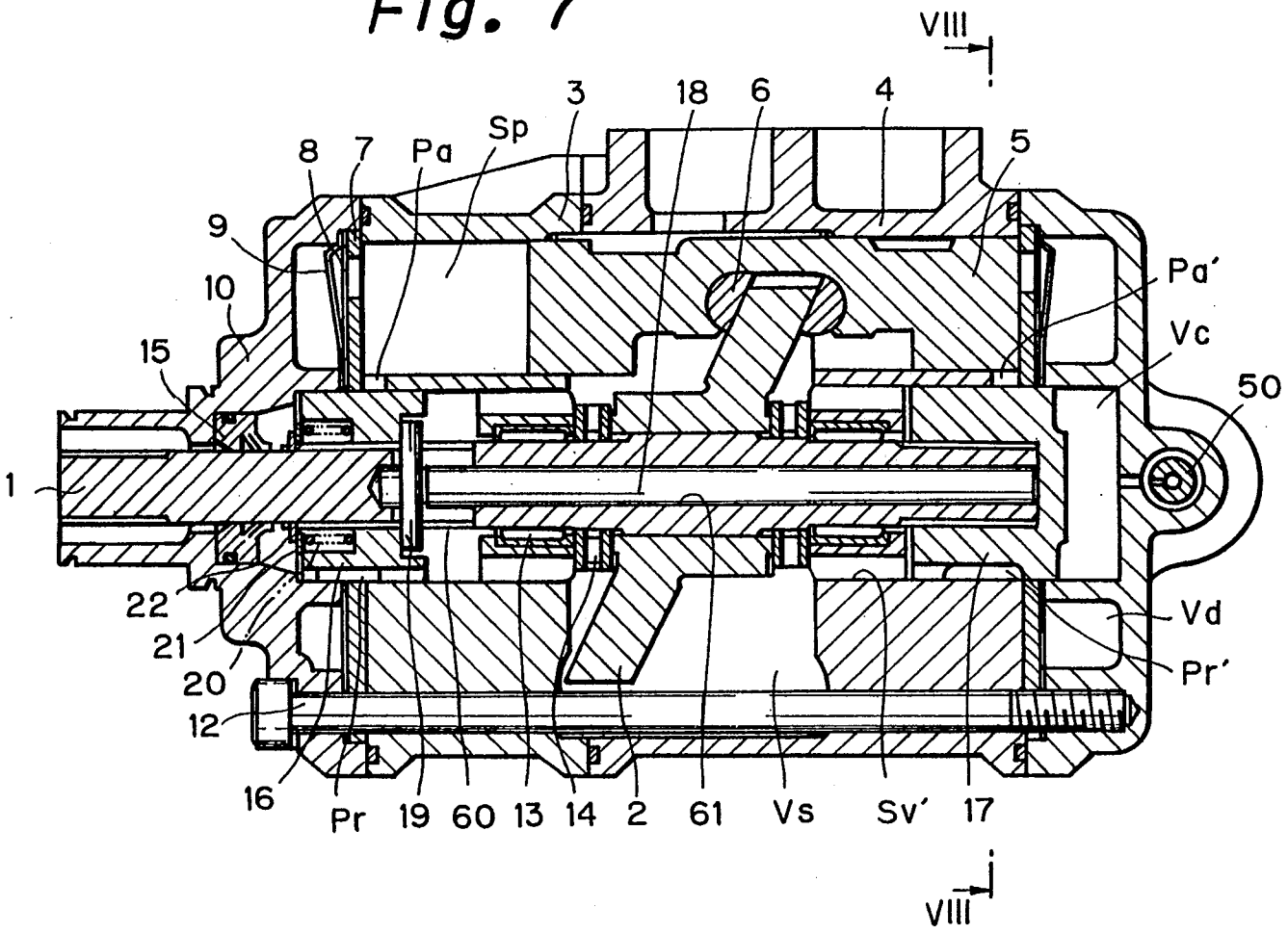
FIG. 7 is similar to FIG. 1, but when under maximum capacity condition, taken along lines VII—VII in FIG. 8.
Figure 8:
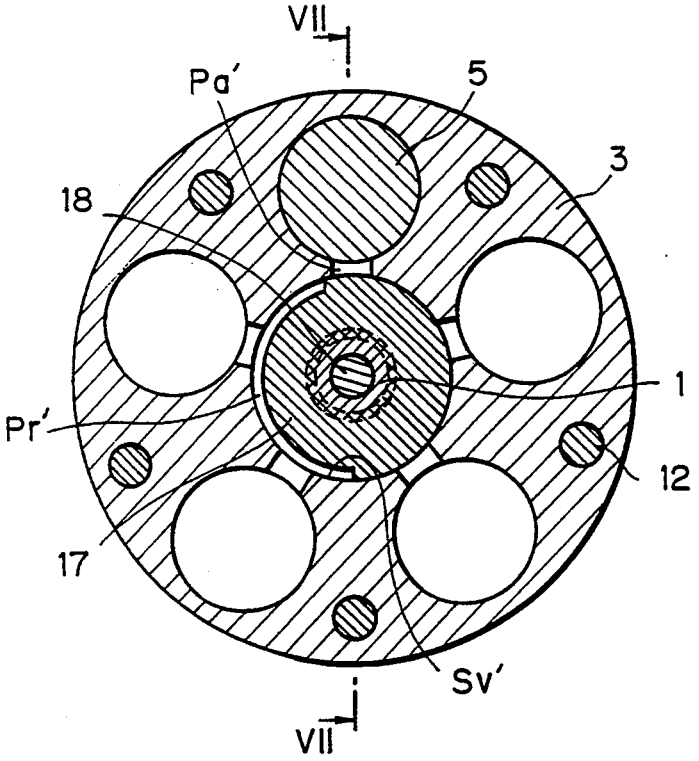
FIG. 8 is a transverse cross sectional view of the compressor taken along line VIII—VIII in FIG. 7.

When the rotary valves 16 and 17 are moved to the respective, most left side (forward) positions, as shown in FIGS. 7 and 8, the maximum value of the rotating angle of about 180 degrees from the angular position at top dead center is obtained, where the variable intake passageway Pr or Pr' is in communication with the piston cylinder Sp or Sp'. Namely, the rotary valves 16 and 17 are under the respective axial positions where the corresponding variable intake passageways Pr and Pr' are in communication with the respective cut grooves Pa and Pa' at a range of a rotating angle from the dead center position A and the bottom center portion. As a result, a maximum value intake volume is obtained.

Figure 3A:
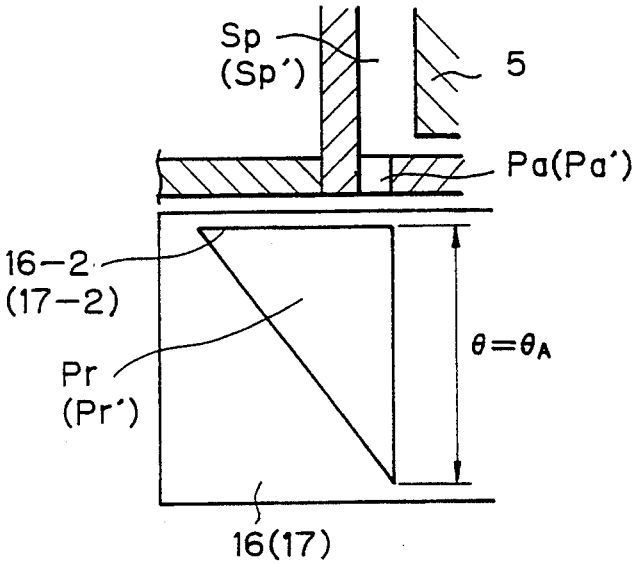
FIGS. 3A and 3B show schematic views illustrating a relationship between the intake passageway with the intake port under the maximum and minimum capacity conditions, respectively.
Figure 3B:
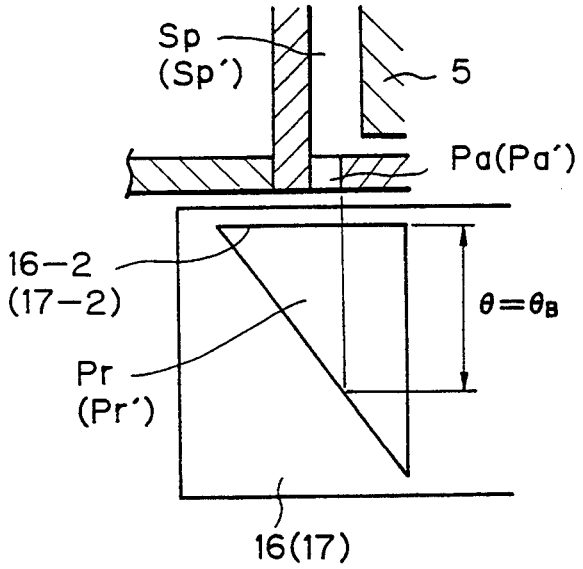

According to the swash plate type variable volume of the present invention, by the axial movement of the rotary valves 16 and 17 on the shaft 1, the angular range where the variable intake passageways Pr or Pr' communicates with the piston cylinder Sp or Sp' via the corresponding cut groove Pa or Pa' is changed so that the volume introduced into the piston cylinder continuously changes Namely, FIG. 3A schematically illustrates a positional relationship between the rotary valve 16 or 17 with the cut groove Pa or Pa' of a piston cylinder Sp or Sp', when the rotary valve is at its most left side position. In this case, the intake passageway Pr or Pr' communicates with the piston cylinder for an angle of $\theta_A$, from the top dead center position. FIG. 3B is similar to FIG. 3A, but illustrates when the rotary valve is at its most right side position. In this case, the intake passageway Pr of Pr' communicates with the piston cylinder for an angle of $\theta_B$, from the top dead center position. Namely, the intake passageway Pr or Pr' commences communication with the cut groove Pa or Pa' at its axial edge 16-2 or 17-2 corresponding substantially to the top dead center position. Thus, the range of the angle $\theta$ continuously varies in accordance with the axial position of the rotary valves 16 and 17. The control of the axial position is effected by the control of pressure at the control chamber Vc, which will be described herein below.

As shown in FIG. 1, the pressure chamber Vc is under the control pressure acting to the rear end **17*a* of the rear rotary valve 17, while the intake pressure in the intake pressure chamber Vs acts upon the front end 17*b* of the rotary valve 17. Thus, a fluid pressure force is applied to the rotary cylinder 17 in the forward direction (left handed direction in FIG. 1), which corresponds to the difference between the pressure Pc in the control chamber Vc and the intake pressure Ps in the intake chamber Vs, multiplied by the cross section area Av of the valve cylinder Sv or Sv'. Namely, the fluid pressure force is equal to $Av \times (Pc - Ps)$. This force is transmitted, via the push rod 18 and the guide pin 19, to the front rotary valve 16, and is opposite to the spring force from the coil spring 20. As a result, the rotary valves 16 and 17 take positions where the fluid force owing to the pressure difference Pc—Ps is balanced with the spring force by the spring 20. As a result, a control pressure Pc can vary so that the desired axial positions of the rotary valves 16 and 17** are obtained according to the present invention.

The control valve 50 in FIG. 6 can create a desired value of the control pressure Pc in the control chamber Vc. Namely, when the force, as generated in the diaphragm 54 based on the intake pressure Ps via the intake pressure port $P_1$, is larger than the force exerted by the spring 56, the diaphragm 54 is moved in a direction upwardly in FIG. 6, thereby causing the ball valve 51 to be seated on the valve seat **52*a*** of the conical shape and the intake port $P_1$ to be disconnected from the control pressure port $P_2$. Since the control pressure port $P_2$ is disconnected from the intake pressure port $P_1$, and the outlet pressure Pd in the output pressure chamber Vd is opened to the control port $P_2$ via the orifice $P_4$, the control pressure Pc is increased to the control pressure Pd.

Contrary to the above, when the force to be generated at the diaphragm 54 by the intake pressure Ps at the intake port $P_1$ is smaller than the force exerted by the spring 56 in the atmospheric air pressure chamber **54*b*, the diaphragm 54 together with the rod 57 contacting thereto is displaced downwardly, so that the rod 57 pushes the ball valve 51 downwardly, and that the ball valve 51 is detached from the valve seat 52***a* of a conical shape, so that the control port $P_2$ is connected to the intake pressure port $P_1$, and that the control pressure Pc at the control port $P_2$ is reduced to the intake pressure Ps. According to the control valve 50 of this embodiment, the force of the spring 56 is obtained when the intake pressure Ps of 2 atm is applied to the diaphragm 54.

In a typical type of an air conditioning system for an automobile, a refrigerating cycle is operated such that an intake pressure Ps of about 2 atm is obtained when the evaporating temperature of the refrigerant is about 0° C. When a thermal load at the refrigerating cycle is higher than the capacity of the compressor, the value of the intake pressure Ps is smaller than 2 atm. In contrast, when the thermal load at the refrigerating cycle is smaller than the capacity of the compressor, the value of the intake pressure is higher than 2 atm.

In the swash plate type variable capacity compressor according to the first embodiment, when there is a value of the intake pressure Ps larger than 2 atm as a result of a large thermal load at the refrigerating cycle, the diaphragm 54 moves upwardly in FIG. 6, thereby causing only the outlet pressure port $P_3$ to communicate with the control pressure port P2, the control pressure Pc to increase, and the rotary valves 16 and 17 to move in the forward direction (left handed direction in FIG. 1) for increasing the capacity of the compressor. Contrary to this, when the value of the intake pressure Ps is smaller than 2 atm due to a low thermal load at the refrigerating cycle, the diaphragm 54 moves downwardly, thereby causing the control pressure port $P_2$ to be also connected to the intake port $P_1$, the control pressure Pc to decrease, and the rotary valves 16 and 17 to move in the rearward direction (right handed direction in FIG. 1) for decreasing the capacity of the compressor. As a result, in a range of the thermal load for obtaining a control of the intake pressure Ps to a value of 2 atm, the compressor is operated so that a capacity is automatically controlled to a value matching the thermal load.

In FIG. 9A, an ordinate is a rotation angle $\theta$ of the rotating shaft 1, and the abscissa is the volume v of the piston cylinder Sp or Sp'. A value of 0° and 360° of the rotating angle corresponds to the top dead center position of the piston 5, and 180° rotating angle corresponds to the bottom dead center position of the piston 5. In FIG. 9B, the abscissa is the v value of the piston cylinder Sp or Sp', and the ordinate is pressure p in the piston chamber Sp. When the variable volume compressor is operating under maximum capacity, the piston cylinder Sp or Sp' is in communication with the intake pressure chamber Vs between the top dead center A and the bottom dead center B thereby executing an intake stroke. Namely, this intake stroke at a maximum capacity is in a rotating angle of 180° between a point a (top dead center: volume is 0) and b (bottom dead center: volume is MAX), where the pressure in the piston chamber has the intake pressure Ps. A compression stroke then occurs between the position b (volume is MAX) and the position c, while the pressure P in the piston chamber is increased along a line m due to compression. At the point c, the delivery valve 8 or 8' is opened to discharge the compressed gas to the delivery chamber Vd. Finally, a delivery stroke follows between the point c and d (volume is 0).

When a partial capacity operation is carried out by moving the rotary valves 16 and 17 in a forward direction, the piston cylinder Sp or Sp' is in communication with the intake pressure chamber Vs for a rotating angle a between top dead center A and the position B of a rotating angle $\theta_0$ so as to execute an intake stroke. Namely, this intake stroke at a reduced capacity is between a point a (volume is 0) and e (volume is $V_0$), where the pressure in the piston chamber is under the intake pressure Ps. An expansion stroke then follows between the position e and the position b', while the pressure P in the piston chamber is decreased along a line n. A compression stroke then follows between the position b' and the position c'. At point c', the delivery valve 8 or 8' is opened for commencing a discharge of the compressed gas to the delivery chamber Vd. Finally, a delivery stroke follows between the point c' and d. Namely, a p-v chart of the variable capacity compressor according to the first embodiment of the present invention is, during the reduced capacity mode, shown by the lines connecting the points in the order of a, e, b', c', d, and a. In this case, the compression drive power corresponds to the area enclosed by the points a, e, c', d, and a, which is equal to the driving power for compression of the volume $V_0$. Thus, the present invention can provide an effective compression operation.

According to the swash plate type compressor of the present invention, an axial position of the rearward rotary valve 17 on the shaft 1 varies, and its movement is transmitted, via the push rod 18 inserted in the shaft 1 and a guide pin 19, to the forward rotary valve 16, so that, for both the rearward and forward rotary valves 16 and 17, the same range of the rotating angle range is obtained for communicating the intake pressure chamber Vs with the piston cylinders Sp and Sp'. Thus, a continuously varied compressor capacity can be obtained irrespective of a highly simplified construction.

Furthermore, according to the present invention, the spring 20 generates an axial force for urging the forward rotary valve 16 to move in a rearward direction, while the control pressure Pc in the control chamber Vc generates a force at the rear surface of the rearward rotary valve 17 in a forward direction by means of the control valve 50 for controlling the control pressure Pc in accordance with the intake pressure Ps, so that the axial position of the rotary valves 16 and 17 can obtain a continuously varied capacity of the compressor and the compressor can always be operated with a suitable capacity corresponding to the thermal load occurring in the refrigerating cycle of the air conditioning apparatus.

According to the present invention, a complicated construction, such as a mechanism for controlling the inclination angle of the swash plate for obtaining the continuously varied capacity in the prior art, can be eliminated, and therefore, the reliability of the operation in the compressor can be increased.

Various modifications of the present invention will now be explained.

According to the first embodiment of the present invention, the variable intake passageways Pr and Pr' having a developed triangular shape are provided for a desired rotating angle range from top dead center A and bottom center B. Contrary to this, according to a second embodiment in FIGS. 10A(1) and 10B(1), the rotary valve 16 or 17 formed with an intake passageway Pr(Pr') having a substantially trapezoidal shape when developed, is formed within a rotating angle range. The rotary valves of the second embodiment are arranged such that the reduction of the capacity is obtained when moved in the opposite direction as that in the first embodiment. In this construction of the rotary valve 16 or 17, FIGS. 11A and 11B show relationships between the volume v in the piston cylinder Sp and the rotating angle $\theta$ and between the volume v and the pressure p. When the compressor, is operating under maximum capacity the piston cylinder Sp or Sp' is as shown in FIG. 10A(2) in communication with the intake port Pa or Pa' for rotating angle ($\theta=180°$) between top dead center A and bottom dead center B so as to execute the intake period between the points a and b. During movement of the rotary valve 16 or 17 from bottom dead center B to top dead center A, a compression period is first obtained between the points b and c, and a delivery period is then obtained between the points c and d, as shown by a line m'. In order to reduce the capacity, the rotary valve is moved from the position in FIG. 10A(2) toward the position in FIG. 10B(2). In the position in FIG. 10B(2), an intake period is obtained when the rotary valve 16 or 17 is moved from top dead center A and bottom dead center B (between the points a and b in FIG. 11B, and communication between the piston cylinders Sp or Sp' continues up to the point E, which is further rotated from bottom dead center B for an angle of $\theta_1$. This range $\theta_1$ of the rotating angle between point b and f corresponding to an intake-discharge stroke where the refrigerant gas under the intake pressure Ps once drawn into the piston cylinder Sp or Sp' is again moved back to the intake chamber Vs until a position f is obtained such that the volume of the piston cylinder Sp or Sp' is reduced to $V_0$. When the position f of the rotary valve 16 or 17 is obtained, communication of the piston cylinder Sp or Sp' with the intake pressure chamber Vs is canceled, so that, during movement up to top dead center A, a compression stroke is obtained between the points f and c', as shown by a line n', and a discharge stroke is obtained between the points c' and d. As a result, according to the swash plate type variable compressor, the p-v chart with a reduced or varied capacity is indicated by lines connecting the points a, b, f, c', d and a, and the compression power corresponds to a value of the figure area encircled by the p-v chart, which corresponds, similar to the first embodiment, to the compression power for the volume $V_0$.

In the above first and second embodiments, the control pressure Pc is applied directly to the rear surface 17*a* of the rotary valve 17. Contrary to this, as shown in FIG. 12, a control piston 24, which is slidable with respect to the casing 11 is arranged on one rear side of the rear rotary valve 17, and a thrust bearing 25 is arranged between axially spaced facing walls of the rotary valve 17 and the control piston 24. As a result, the control pressure in the control chamber Vc is applied to the rotary valve 17 by way of the control piston 24 and the thrust bearing 25.

A third embodiment of the present invention will be explained with reference to FIG. 13. In place of using the control valve 50 as a three port valve, which is responsive to the intake pressure Ps modified to the control pressure Pc, a control valve is employed, which is, as shown in FIG. 13, basically constructed by a bellows 74 and a spring 72. In this construction of the control valve, a reference numeral 70 is a cover having a flanged cup shape fixedly connected to the rear casing 11 by means of bolts 75 via a diaphragm member 74 made of a rubber material. As shown in FIG. 14, the diaphragm member 74 is sandwiched between a cup shaped spring holder 71 and a cap member 73 that is fixed to the holder 71. A spring 72, on its first end, rests on the inner surface of the cup 70, and on its second end, rests on the opposite inner surface of the holder 71 so that the diaphragm member 73 is displaced in the direction toward the rear rotary valve 17. The cap 73 has, at its side faced with the rotary valve 17, a projected portion 77 of a hemispherical shape that contacts the facing end surface of the rotary valve 17. The cover 70 forms an air inlet 76 open to the atmosphere, so that a space inside the body is subject to an atmospheric pressure, which acts on the side of the bellows member 74 facing the cup member 71.

The operation of the swash plate type compressor as shown in FIG. 13 controls the axial movement of the rotary valve 16 and 17 will be explained with reference to FIG. 15. S is a pressure receiving area of the bellows member 74, Kf and Kr are spring factors for the springs 20 and 72, respectively, of and or shrink with respect to the length of the springs 20 and 72, respectively during the minimum capacity of the compressor, i.e., when the rotary valves 16 and 17 move in the most left hand (forward) direction in FIG. 15, and x is the axial movement of the rotary valves 16 and 17 from a position during the minimum capacity of the compressor. The balance of forces applied to the rotary valves provides the following equations;

$$Kf \times (\delta f + x) + S \times (Ps - 1) = Kr \times (\delta r - x) \quad (1)$$

$$x = \frac{S}{Kf + Kr} \times Pa + \frac{Kr \times \delta r - Kf \times \delta f + S}{Kf + Kr} \quad (2)$$

The equations (1) and (2) show that the amount of the displacement of the rotary valves 16 and 17 on the shaft 1 is inversely proportional to the intake pressure Ps. Namely, a reduction in the intake pressure Ps causes the rotary valves 16 and 17 to move in the rearward (right handed) direction, thereby reducing the capacity of the compressor.

According to this embodiment, the factors, such as spring factors Kf and Kr of the springs 20 and 72, respectively, are such that a movement of the rotary valves 16 and 17 between the minimum capacity position and the maximum capacity position is obtained when a value of the intake pressure Ps is around 2 atm, i.e., the maximum capacity is obtained when intake pressure is 2 atm, while minimum capacity is obtained when the intake pressure is 1.9 atm. Namely, operation of the compressor in accordance with the thermal load is obtained such that a large thermal capacity is obtained when the load is high, and a small thermal capacity is obtained when the load is low. As a result, the maximum power consumption efficiency of the compressor is obtained.

According to this embodiment in FIG. 13, no provision regarding the control valve 50 in the first embodiment is made, thereby reducing manufacturing costs. A reduction in cost is also obtained because a communication means for introducing the pressure signals is unnecessary in the compressor housing, which allows machining time to be reduced. Elimination of the control valve 50 is advantageous in that a refrigerating cycle is not necessary, which would otherwise occur because of the response of the control valve 50.

In the embodiment in FIG. 13, in place of directly contacting the cap 73 (the projected portion 77) with the rotary valve 17, a thrust bearing 25 can be provided as shown in a modification in FIG. 16. Namely, the thrust bearing 25 is arranged in series between the rotary valve 17 and the cap 73 in such a manner that a transmission of the axial load occurrs between the cap 73 and the rotary valve 17 by way of the thrust bearing 25.

FIG. 17 shows a different embodiment, wherein a bellows member 80 made of a metal sheet material is provided. The bellows member 80 has a first end to which a cap 82 forming a hemispherical shaped projection 82-1 contacting the rear end wall of the rotary valve 17 and a second end to which an annular shaped base member 81 is connected. The base member 81 is, at its outer periphery, sandwiched between the body 84 and a cover plate 83, which is fixedly connected to the body 84 by a suitable means. A spring 72 is arranged inside the bellows member 72, which is opened to the atmosphere via an opening 76 formed in the cover 83. The spring 72 is for urging the cap 82 toward the rotary valve 17. Similar to the embodiment in FIG. 16, an intake pressure Ps is opened to the space 80-1 outside the bellows member 80.

According to the construction in FIG. 17, a shrinkage of the bellows member 80 in accordance with the intake pressure Ps is obtained, similar to the operation in FIG. 13.

In the embodiment of the control valve 50 in FIG. 6, the intake pressure Ps and the discharge pressure Pd in the respective chambers in the compressor are utilized for controlling the pressure Pc in the control chamber Vc. In place of the pressures Ps and Pd inside the compressor, outside pressure sources, such as a compressor, can be used. Namely, the pressure of the outside pressure sources are used in the control valve 50 to obtain a desired control pressure chamber pressure in the control pressure chamber Vc. Furthermore, in place of using the refrigerant gas pressure values for controlling the axial position of the rotary valves 16 and 17, an electric actuator, such as an electric motor, can be employed so that the axial position of the rotary valves 16 are 17 are electrically and directly controlled.

Another embodiment is shown in FIG. 18. In place of the double headed pistons in the first embodiment in FIG. 1, the compressor in the embodiment in FIG. 18 has pistons 5, each of which forms a single piston chamber on only one side thereof. Namely, a swash plate 2 is connected to a rotating shaft 1. The swash plate 2 has a boss portion 2-1, on which an annular plate 92 is connected via a radial bearing 91, and is connected thereto by means of a circlip 2-3. A thrust bearing 90 is arranged between facing surfaces of the swash plate 2 and the plate member 92. A coil spring 2-4 is provided for urging the swash plate so that it is forced to a facing inner wall of the housing 10 via a thrust bearing 2-5. As a result, the plate member 92 is rotated together with the rotation of the rotating shaft 1. Piston rods 93, only one of which is shown, are for obtaining the axial reciprocating movement of the pistons 5 by the rotation of the swash plate 2. The plate member 92 is substantially semicircular shaped, with an outward opened recess, to which the piston rod 93 is engaged at its one end 93-1. Contrary to this, each piston 5 has an inner boss portion that is semicircular, and opens axially outward to which the piston rod 93 is engaged at its other end 93-2. The cylinder block 4 forms a plurality of circumferentially spaced cylinder bores 4-1, to which the respective pistons 5 axially and slidingly reciprocate so as to create piston chambers Sp. Upon such an axial reciprocating movement of the pistons 5 in the respective cylinder bore Sp by the rotating movement of the swash plate 92, the volume of the compression chambers Sp varies so as to obtain a compression operation of the gas.

In the embodiment in FIG. 18, which is similar to the first embodiment in FIG. 1, cut grooves Pa are opened for the respective cylinder bore Sv. A rotary valve 17 forming an intake passageway Pr is spline engaged with the rotating shaft 1, as explained with reference to the first embodiment while referring to FIG. 5, so that a control chamber Vc is formed on one side of the rotary valve 17 facing the casing 11. An intake pressure chamber Vs, which is in communication with a source of the fluid medium to be compressed, is formed inside the compressor. The intake pressure chamber Vs is opened to the other side of the rotary valve 17 which is remote from the control pressure chamber Vc. A coil spring 20 is provided for urging the rotary valve 17 in the right hand direction in FIG. 18. Similar to the first embodiment, a control valve 50 is provided for controlling the pressure in the control chamber for controlling an axial position of the rotary valve 17 on the shaft for controlling the capacity of the compressor. This embodiment operates similar to the first embodiment and obtains the same effect.

Another embodiment will now be explained with reference to FIGS. 19 to 24. In this embodiment, similar to the previous embodiments, on a rotating shaft 1 connected to a crankshaft of an internal combustion engine by way a clutch (not shown), a swash plate 2 is fixedly connected. The rotating shaft 2 is rotatably supported on cylinder blocks 3 and 4 by means of radial bearings 13, and thrust bearings 14. Five double headed pistons 5 are axially and slidably inserted in respective cylinder bores 3-1 and 4-1 of the respective cylinder blocks 3 and 5 to create the respective piston chambers Sp and Sp', which are circumferentially spaced at an angle of one fifth of 360 degrees. See FIG. 20 which shows the maximum capacity. These pistons 5 are connected to the swash plate 2 via respective pairs of shoes 6 having a substantially semicircular shape, so that an axial reciprocating movement of the pistons 5 in the corresponding cylinder bores 3-1 and 4-1 is obtained. At the spaced ends of the cylinder blocks 3 and 4, valve plates 7 and 7', delivery valves 8 and 8' and valve stoppers 9 and 9' are arranged, and are connected to the cylinder blocks 3 and 4 by means of circumferentially spaced five bolts 13. A shaft seal assembly 15 is arranged in the front housing 10 so that its inner edge contacts the outer surface of the rotating shaft 1.

The embodiment of FIG. 19 features axially spaced control pressure chambers Vc and Vc' formed on the outer sides of the front and rear rotary valves 16 and 17, and the shaft 1 forms an axial opening 1-1 therethrough and radial openings 1-2 and 1-2' for defining a control pressure passageway Pc for connecting the control pressure chambers Vc and Vc' with a control port $P_2$ of the control valve 50.

As shown in FIGS. 21 to 23, the rotary valves 16 and 17 are, at front and rear ends, connected to the shaft 1 by means of keys 100 and 100', which are fixed to the shaft 1, on one hand, and are fitted to key grooves 106 on the rotary valves, on the other hand, so that the rotation of the shaft 1 is transmitted to the rotary valves 16 and 17, while the latter are axially slidable on the shaft 1. Axially spaced coil springs 101 and 101' are arranged between the rotary valves 16 and 17 and shoulders 102 formed on the shaft 1, so that the rotary valves 16 and 17 are urged axially outward. Namely, in FIG. 19, the front rotary valve 16 is urged in the left handed direction by the spring 101, while the rear rotary valve 17 is urged in the right handed direction by the spring 101'. Circlips 104 and 104' are fixedly mounted on the shaft 1, while shoulders 103 are formed on the shaft 1. The axial movement of the rotary valves are, therefore, allowed between a position where the rotary valves 16 and 17 contact the respective circlips 104 and a position where the rotary valves 16 and 17 contact the respective shoulders 103.

The rotary valve 16 has, as shown in FIG. 22, a sleeve shape defining thereon recess 16-5 for creating an intake passageway Pr of a triangle shape when developed. A plurality of circumferentially spaced openings 105 are formed in the rotary valve 16 so that each of the openings 105 is, at one end, opened to the rear end surface of the rotary valve 16 and is, at the front end, opened to the recess 16-5, which allows the intake passageway Pr to be opened to the intake pressure chamber Vs, so that the intake passageway Pr is subject to the intake pressure. Similarly, the rotary valve 17 has, as shown in FIG. 23, a sleeve shape defining thereon recess 17-5 for creating intake passageway Pr' having a triangle shape when developed. A plurality of circumferentially spaced openings 105-1 are formed in the rotary valve 17 so that each of the openings 105-1 is, at one end, opened to the front end surface of the rotary valve 17 and is, at the rear end, opened to the recess 17-5, which allows the intake passageway Pr' to be opened to the intake pressure chamber Vs, so that the intake passageway Pr' is subject to the intake pressure. The rotary valves 16 and 17 are connected to the shaft 1 such that, when the piston 5 is in its dead center position, i.e., the piston most approaches the valve plate 7 or 7', the axial edge portion 16-2 or 17-2 of the recess is opened to the corresponding cut groove Pa or Pa'. Thus, the front rotary valve 16 and rear rotary valves 17 are positioned on the shaft 1 so that an angle of 180 degree difference is obtained between the angular positions of the front and rear rotary valves 16 and 17.

The cylinder blocks 3 and 4 form axially spaced valve bores Sv and Sv', in which the rotary valves 16 and 17, respectively, are slidably and rotatably stored while maintaining a small clearance. The communication grooves Pa and Pa' extend in a direction inclined with respect to the axis of the shaft 1 so as to be opened to the corresponding cylinder bores 3-1 and 4-1, as shown in FIGS. 19 and 20. Upon the rotating movement of the rotary valve 16 or 17 in the cylinder bore 3-1 or 4-1, the intake passageway Pr or Pr' for a piston chamber Sp or Sp' communicates with a cut groove Pr or Pr' on the rotary valve 16 or 17 for a rotating angle. Namely, such communication of the intake passageways Pr and Pr' occurs successively with respect to the circumferentially spaced piston cylinders Sp and Sp', respectively, upon one complete rotation of the rotary valves 16 and 17 as shown by an arrow in FIG. 20 in the cylinder bores Sv and Sv, respectively.

As shown in FIG. 19, the control valve 50 is arranged in the rear casing 11, and is fixedly connected thereto by means of a circlip 107. The control valve 50 is, as shown by FIG. 24, constructed as a three port valve having ports P1, P2 and P3, which are opened to the intake pressure chamber Vs, the outlet pressure chamber Vd and the control pressure chamber Vc, respectively. The control valve 50 includes a housing 108 defining a conical shaped first valve seat 109, a cap 110, a ball shaped valve 113 arranged between the first and second valve seats 109 and 111, and a coil spring 112 urging the ball valve 112 so that the ball valve 112 is seated on the first valve seat 109 so that the ball valve 113 controls communication between the control pressure port P3, the intake pressure port P1, and the outlet pressure port P2. The control valve 50 is further provided with a diaphragm 114 that is arranged between the faced end surfaces of housings 108 and 115. Formed on one side of the diaphragm 114 is a first diaphragm chamber 115 that is opened to the intake pressure port P1, so that the chamber 115 is under the intake pressure. Formed on the opposite side of the diaphragm 114 is a second chamber 116 opened to the atmosphere via an opening 117. As a result, displacement of the diaphragm 114 occurs in accordance with the difference between the force as generated by the pressure difference between the intake pressure at the first chamber 115 and the atmospheric pressure at the second chamber 116, and the force as generated by a spring 119 arranged in the second chamber 116. The control valve 50 is further provided with a rod 120, which is for displacement transmission of the diaphragm 114 to the ball valve 113 so as to lift it from the valve seat 109, so that the outlet pressure P2 at the outlet pressure port P2 is opened to the control pressure port P3. The upper end of the rod 120 is connected to the diaphragm by means of a pair of retainer plates 118 via a ball. The lower retainer plate is fixedly connected to the top end of the rod 120.

The operation of the embodiment in FIGS. 19 to 24 will now be explained. The rotation of the shaft 1 causes the swash plate connected to the shaft 1 to rotate, so that the pistons connected to the swash plate 2 via respective pairs of shoes are axially reciprocated in the respective cylinder bores Sv and Sv'. Simultaneously with the rotational movement of the shaft 1, the rotary valves 16 and 17 connected to the rotating shaft 1 by means of the keys 100 and 100 are rotated in the respective valve cylinders Sv and Sv'. Due to the fact that the variable intake passageways Pr and Pr' on the outer walls of the rotary valves 16 and 17 are always subject to the intake pressure so that the piston cylinders Sp, which are in communication with the intake passageway Pr and Pr' via the corresponding cut grooves Pa and Pa', respectively, are always subject to the intake pressure.

According to the embodiment in FIGS. 19 to 24, the variable intake passageway Pr or Pr' on the rotary valve 16 or 17, respectively communicates with an intake port Pa or Pa of a corresponding piston chamber Sp or Sp' at a particular rotating angle from a position adjacent the top dead center to a position before bottom dead center, which varies in accordance with the position of the rotary valve 16 or 17, so that, at a particular rotating angle, an intake of refrigerant gas to a piston chamber Sp or Sp' occurs. A rotation of the rotary valve 16 of 17 to a position out of a particular range causes the variable intake passageway Pr or Pr' to be disconnected from the corresponding cut groove Pa or Pa, which causes the corresponding piston chamber Sp or Sp' to be disconnected from the intake pressure chamber Vs. As a result, at the point where the variable intake passageway Pr or Pr' of the rotary cylinder 16 of 17 is disconnected from the cut groove Pa or Pa', an amount of refrigerant gas confined in the corresponding piston chamber Sp or Sp' corresponds to the capacity of the compressor at that instant.

In FIG. 19, by operating the control valve 50, the rotary valve 16 is at its most left side (outward) position, while the rotary valve 17 is at its most right side (outward) position. Under these conditions, as shown in FIG. 20, the variable intake passageway Pr of Pr' of the rotary valve 16 or 17 is in communication with the corresponding piston chamber Sp or Sp' for the widest rotating angle of 180 degrees from top dead center, as shown in FIG. 20, so that a maximum amount of refrigerant gas is admitted into the corresponding piston chamber Sp or Sp'. In contrast, when the rotary valve 16 is moved to its most right side (inward) position in FIG. 25 from the position in FIG. 19, while the rotary valve 17 is moved to its most left side (inward) position in FIG. 25 from the position in FIG. 19, the variable intake passageway Pr of Pr' of the rotary valve 16 or 17 is in communication with the corresponding piston chamber Sp or Sp' for the narrowest rotating angle of 25 degrees from top dead center as shown in FIG. 26, so that a minimum amount of refrigerant gas is admitted into the corresponding piston chamber Sp or Sp'. In short, as a result of the axial movement of the rotary valves 16 and 17, the rotating range for obtaining communication between the respective piston chambers Sp and Sp' and the intake pressure chamber varies, so that the outlet capacity continuously changes between the maximum valve and the minimum valve corresponding to about 25% capacity of the maximum capacity.

As explained above, according to the swash plate type compressor in the embodiment in FIGS. 19 to 26, by the axial movement of the rotary valves 16 and 17 on the shaft 1, the angular range at which is the a triangular intake passageway Pr or Pr' on the rotary valve 16 or 17 varies, so that the volume of the refrigerating gas introduced into the corresponding piston chamber Sp or Sp' continuously varies. FIG. 26 shows the minimum capacity.

Furthermore, the change in the control pressure in the control chambers Vc and Vc' causes the axial positions of the rotary valves 16 and 17 on the shaft 1 to vary. The control chambers Vc and Vc' are delimited by the rotary valve 16 and 17, the cylinder blocks 3 and 4, and the front and the rear casings 10 and 11, and are disconnected from the intake pressure chamber Vs and the outlet chambers Vd and Vd'. In addition, the front and rear control chambers Vc and Vc are connected to each other by means of the control pressure communication passageway Pc in the shaft 1, so that the pressure in the control chambers Vc and Vc' is equalized. A force due to the control pressure is applied to the sides of the control valves 16 and 17 adjacent to the control pressure chambers Vc and Vc', respectively, while a force due to the intake pressure Ps and a force due to the springs 101 are applied to the other sides of the control valves 16 and 17. As a result, when the control pressure in the control chambers Vc and Vc' is within a suitable range, the rotary valves 16 and 17 move to positions where forces applied to the opposite ends of the rotary valves are balanced, so that control of the control pressure can continuously control the capacity of the compressor. The control pressure in the control chambers Vc and Vc' is obtained by the control valve 50 as shown in FIG. 24.

As in the first embodiment where the combination of the push rod 18 and the guide pin 19 as shown in FIG. 5 is used to obtain a unified movement of the first and second rotary valves 16 and 17, the unified movement of the first and second rotary valves 16 and 17 in the embodiment in FIG. 19 to 26 is obtained by the provision of the communication passageway Pc formed in the shaft 1. Thus, the latter embodiment is advantageous in that a reduction in the number of parts and a reduction in cost is obtained, and the compressor is easily assembled.

Figure 2B:
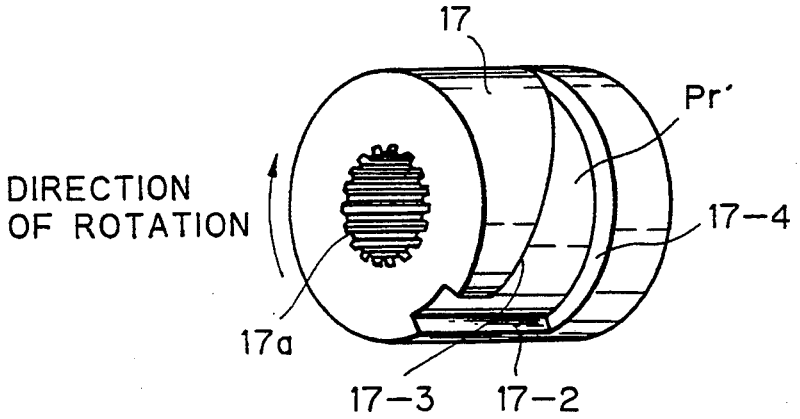

According to the embodiment in FIGS. 19 to 26, it is shown that the rotary valves 16 and 17 are provided with a recess for defining the variable intake passageways Pr and Pr' in communication with the intake pressure chamber Vs via the communication openings 105 as shown in FIGS. 22 and 23. In place of this construction in FIGS. 22 and 23, a construction of the intake passageways Pr and Pr' on the rotary valves 16 and 17, respectively, as shown in FIGS. 2A and 2B may be provided for obtaining communication between the intake pressure chamber Vs and the recess for forming the variable intake passageways Pr and Pr'.

FIG. 27 shows a seventh embodiment, which is a modification of the 6th embodiment in FIG. 19, in that springs 101 and 101' having a different spring coefficient are provided for generating forces urging the rotary valves 16 and 16, respectively, in directions opposing the forces exerted by the control pressure in the control chambers Vc and Vc', respectively. Namely, the spring coefficient of the spring 101 on the left-hand side of FIG. 27 is larger than that of the spring 101' on the right-hand side. Thus, the increase in control pressure Pc, first, causes the rotary valve 17 on the right hand side to move against the spring 101'. After the control pressure Pc increases to a level for obtaining a desired stroke of the rotary valve 1, the force exerted by the control pressure Pc exceeds the set force exerted by the spring 101, thereby causing the rotary valve 16 to move against the force of the spring 101. In comparison with the 6th embodiment in FIG. 19, where the rotary valves 16 and 17 are fitted to the corresponding valve cylinder bores Sv and Sv' as closely as possible in order to prevent a leak between the control pressure chambers Vc and Vc' and the intake pressure chamber Vs, the 7th embodiment employs annular seal members 122 and 122', and 123 and 123' arranged on an annular recess formed on the outer cylindrical walls of the rotary valves 16 and 17 in such a manner that the seal members 122 and 123 make contact with the facing inner cylindrical walls of the cylinder bores Sv and Sv' for obtaining a desired seal effect, without maintaining a strict clearance between the rotary valves 16 and 17 and the rotary valve cylinder bores.

According to the 7th embodiment in FIG. 27, a varying operation of the compressor capacity is obtained by the right hand (rear) side rotary valve 17 in a range (large capacity range) between 100 to 60% of the full capacity, and by the left hand (front) side rotary valve 16 in a range (small capacity range) between 60 to 20% of the full capacity. As a result, a more precise control of the compressor capacity is obtained by the compressor in this 7th embodiment.

FIG. 28 shows an 8th embodiment, which is a modification of the 6th embodiment. Namely, in comparison with the 6th embodiment in FIG. 19, the control pressure chambers Vc and Vc' are located axially outward with respect to the corresponding rotary valves 16 and 17; the 7th embodiment provides a construction wherein a control pressure chamber Vc is formed between the cylinder blocks 3 and 4, to which the control pressure port P3 connected to the control valve 50 is opened. In FIG. 28, the intake pressure chamber is not shown, but is formed by the cylinder blocks 3 and 4, the casings 10 and 11, and the rotary valves 16 and 17. The control pressure chamber Vc is located axially inward of the corresponding rotary valves 16 and 17. As a result, the arrangement of the variable intake passageways Pr and Pr' is opposite from those as shown in FIGS. 2A and 2B or FIGS. 22 and 23. Furthermore, the springs 101 and 101' are arranged outwardly from the respective rotary valves 16 and 17, and collars 124 and 124' are fixedly connected to the shaft 1, on which the respective springs 101 and 101' are placed. The detailed construction of the control valve 50 is not shown in FIG. 28, but operates in a similarly manner as that in the previous embodiments. Namely, an intake pressure port P1, a control pressure port P2, and outlet pressure port P3 are provided in a similar way as that shown in FIG. 6, so as to obtain the designated function of the control valve 50. This embodiment operates in a similar manner as that of the 6th embodiment in FIGS. 19 to 26. The embodiment in FIG. 28 is combined with the 7th embodiment in FIG. 27. The seal members 122 and 122' and 123 and 123' may be provided on the rotary valves 16 and 17 for obtaining the sealing function.

In the above embodiments, the compressor is provided with double headed pistons 5 defining piston chambers Sp and Sp' on their opposite sides, and the volume of the piston chambers Sp and Sp' varies. However, a means such as an orifice is provided so that the volume of the piston chambers on one side, for example, the rear side piston chambers Sp' varies, first, and, then the volume of the piston chambers on the other side, for example, the front side piston chambers Sp varies.

FIG. 29 shows the 9th embodiment, which is a modification of the embodiment in FIG. 28. Namely, in place of the control valve operated by fluid pressure, an electro-magnetic valve 125 as a control valve is provided. Namely, the control valve 125 is provided with a valve device 125-1 similar to that shown in FIG. 24, and an electromagnetic actuator 125-2. The actuator 125-2 is connected to a control circuit such a microcomputer system to obtain a desired control of the capacity of the compressor. Namely, similar to the first embodiment in FIG. 6, an intake pressure port $P_1$, a control pressure port $P_2$ and outlet pressure port $P_3$ are provided so that communication of the control pressure port $P_2$ with respect to the intake pressure port $P_1$ and the outlet pressure port $P_3$ is controlled by a ball valve 126 operated by the actuator 125-2 so that a target pressure is obtained.

It should be noted that the valve cylinder bores Sv and Sv', at inner cylindrical sliding surfaces face the rotary valves 16 and 17, and have coatings for obtaining a desired sliding movement of the rotary valves 16 and 17.

FIGS. 30 to 33 show a 10th embodiment of the present invention. The compressor includes cylinder blocks 3 and 4, and front and rear casings 10 and 11, which are connected to each other by means of bolts 12. The cylinder blocks 3 and 4 form equiangularly spaced five pairs of cylinder bores 3-1 and 4-1 in which double headed pistons 5 are axially and slidably inserted, so that piston chambers Sp and Sp' are formed on the side of the pistons 5 facing the front and rear housings 10 and 11, respectively. Annular delivery chambers Vd and Vd' are formed inwardly of the front and rear casings 10 and 11, respectively, so that they are connected to a refrigerating line for an air conditioning system for a vehicle, in particular, a condenser. Valve seats 7 and 7' are arranged between the facing surfaces of the cylinder block 3 and the casing 10, and the cylinder block 4 and the casing 11, respectively. The valve seat 7 and 7' forms delivery ports 7-1 and 7'-1 opened to the respective cylinder chambers Sp and Sp', respectively, which are opened or closed by respective valve plates 8 and 8', and backed by valve stoppers 9 and 9', respectively.

A rotating shaft 1, which is connected to the crankshaft of an internal combustion engine (not shown), is supported by radial bearings 13 and 13', and a swash plate 2 is connected to the rotating shaft 1 via thrust bearings 14 and 14'. The swash plate 2 is connected to the pistons 5 by means of shoes 6. An intake pressure chamber Vs is formed in the space for storing the swash plate 2.

As shown in FIG. 30, the shaft 1 is, at a location adjacent to and inwardly of the bearing 13, a large diameter portion 1-3. A valve cylinder bore Sv is formed in the cylinder block 3, in which the large diameter portion 1-3 is axially and slidably inserted with a limited clearance. As will be explained later, according to this 10th embodiment, this portion 1-3 integral to the shaft 1 operates as a fixed front rotary valve. Namely, the cylinder block 3 forms circumferentially spaced intake ports Pa which are, at their outer ends, opened to the respective cylinder bores 3-1, and are, at their inner end opened to the inner cylindrical wall of the valve bore Sv. The enlarged diameter portion 1-3 forms a groove having a fan shaped groove 36 for forming a fixed intake passageway, which is formed along the circumference for an angle of about 130 degrees. The shaft 1 forms an intake passageway 1-4, and the fixed intake passageway Pr is opened to the passageway 1-4 at its front end. As shown in FIG. 30, the rotating shaft 1 and a boss portion of the swash plate 2 forms a radial intake passageway 1-5, which is for connecting the other end of the passageway 1-4 with the intake pressure chamber Vs. In the embodiment as shown, the radial passageways 1-5 are recess opened laterally at the boss portion of the swash plate 2. These intake ports Pa are closed by respective pistons 5 when the piston 5 move to top dead center position (left most position), so that the piston chamber Pv is disconnected from the groove 36, but is opened to the ports Pa when the piston 5 changes its direction of movement toward the bottom dead center position.

As shown in FIG. 30, the cylinder block 4 forms a rear valve cylinder Sv', in which a rear rotary valve 17 is axially and slidably stored with a small clearance. The space inside the rotary valve 17 is in communication with a cylindrical bore at the right hand (rear) end of the rotating shaft 1, so that an additional intake pressure chamber 39 is created. The rotary valve 17 is constructed as shown in FIG. 32, and is inserted to the valve cylinder Sv' from its right hand side, so that it is axially slidable while rotating together with the rotating shaft 1. In order to obtain such a connection of the rotary valve 17 with the rotating shaft 1, the rotating shaft 1 forms, at its tubular rear end portion, diametrically opposite slits 42 that extend axially up to the free end of the shaft 1. A stopper member 44 is arranged inside the tubular portion of the shaft 1. The stopper member 44 is provided with diametrically opposite guide pins 43 that extend radially outward, so that the guide pins 43 are passed through the slits 42. The rotary valve 17 is formed with diametrically opposite grooves 45, to which the outer ends of the guide pins 43 are engaged. As a result of this construction, the rotational movement of the shaft 1 is transmitted to the rotary valve 17 via the guide pins 43 engaging the slits 42 of the shaft 1 and groove 45 of the rotary valve 17. Note: the stopper member 44 forms therein with axial openings 46 therethrough, which allows the refrigerant gas to freely pass.

As shown in FIGS. 30 and 31, the rear cylinder block 4 forms equiangularily spaced intake ports Pa' that are, at their outer ends, opened to the respective rear cylinder bores 4-1, and are, at their inner ends, opened to the rear valve bore Sv'. These intake ports Pa' are closed by the respective pistons 5 when the piston 5 is moved to its top dead center position (right most position), so that the piston chamber Pv' is disconnected from the respective intake passageway Pa', but is opened to the ports Pa' when the piston 5 changes its direction of movement toward the bottom dead center position.

As shown in FIG. 32, the rear rotary valve 17 for an intake port Pr', which is constructed by a first portion of a wider axial length of $L_1$, and a second portion of a narrower axial length of $L_2$ of an angular extension of an angle $\theta_2$ from top dead center of the corresponding piston 5. The introduction of the refrigerant gas from the intake pressure chamber Vs to the corresponding piston chamber Sp' occurs for a period where the intake passageway Pr' is opened to the intake port Pa. When the rotary cylinder 17 is in an axial position (left handed position in FIG. 30) where the intake port Pa is connected to both the wider and narrower length portions, such a connection occurs for a larger angle of $\theta_1$ from top dead center ($\theta=0°$) of the corresponding piston 5, so that a large capacity of the compressor capacity is obtained. When the rotary cylinder 17 is in an axial position (right handed position in FIG. 30) where the intake port Pa' is connected only to the wider length portions, such a connection occurs for a larger angle of $\theta_2$ from the top dead center ($\theta=0°$) of the corresponding piston 5, so that a small compressor capacity is obtained. Thus, continuous control of the refrigerant introduced into the piston chambers Sp' for compression is obtained in accordance with the position of the rotary valve 17. An edge of the recess for forming the intake port Pr of Pr as inclined and explained with reference to FIGS. 2B and 3B for the first embodiment can obtain a continuously varied capacity.

In the embodiment of the rear rotary valve 17 shown in FIG. 32, the portion of the intake passageway Pr' having a larger rotating angle $\theta_1$ and the portion of the intake passageway Pr' having a smaller rotating angle $\theta_2$ start at the same point in one complete rotation of the rotary valve 17. When a large capacity is required in the air conditioning system, the rotary valve 17 is moved to the position where the intake port Pr' is opened to the portion of the intake passageway Pr' having a larger rotating angle $\theta_1$. When a small capacity is required in the air conditioning system, the rotary valve 17 is moved to a position where the intake port Pr' is opened to the portion of the intake passageway Pr' having a smaller rotating angle $\theta_2$. FIG. 33 is similar to FIG. 9A for the first embodiment, which illustrate a relationship between the rotating angle and the volume of the piston chamber or stroke of the piston. Under the full capacity conditions, an intake stroke occurs in a range between top dead center and an angle position of $\theta_1$. When the capacity is reduced, an intake stroke occurs in a range between top dead center and to an angle position of $\theta_2$.

In order to obtain a desired axial position of the rear rotary valve 17 on the shaft 1 a control piston 49 is provided, which is axially and slidably inserted in an axially and inwardly opened cylinder bore 11-2 formed in the rear casing 11 via an annular seal 201. A control pressure chamber Vc is formed on one side of the control piston 49 remote from the rotary valve 17. A control valve 50 having a similar construction as explained with reference to the first embodiment in FIG. 1 is provided for controlling pressure in the control pressure chamber Vc, so that the control pressure varies in accordance with the intake pressure Ps and the outlet pressure Pd in a similar way as explained with reference to the first embodiment. A spring 200 is provided for urging the stopper member 44 and the rotary valve 17 in the right hand (rearward) direction in FIG. 30, while a spring 202 is arranged in the control pressure chamber Vc for urging the rotary valve 17 in the left hand direction. As a result, the axial position on the shaft 1 is obtained in such a manner that a balanced condition is obtained between the spring force exerted by the springs 200 and 202 and the fluid force exerted by the control pressure in the control pressure chamber Vc and the intake pressure in the intake pressure chamber Vs, as explained with reference to the previous embodiment. Namely, by changing the control pressure by the control valve 50, a desired axial position of the rotary valve 17 and a desired compression capacity is obtained.

Similar to the previous embodiment, capacity control by the control valve 50 can be carried out automatically in accordance with the refrigerant pressure in the refrigerating cycle as explained with reference to FIG. 6 for the first embodiment. It is also preferable that the capacity control be effected manually by the driver or a passenger.

A thrust bearing 204 is arranged between the control piston 49 and the rotary valve 17 for preventing the control piston 49 from rotating even if the rotary valve 17 is rotating.

According to the 10th embodiment, although there is a continuously varying volume of refrigerant gas introduced into the rear side piston chambers Sp' by means of the rear rotary valve 17, which is similar to the previous embodiments, the amount of refrigerant gas introduced into the front side piston chambers Sp is in an "ON-OFF" manner. Namely, a puppet valve 210 is provided for moving between a closed position where the intake passageway 1-4 at the enlarged diameter portion 1-3 is closed, and an opened position where the intake passageway 1-4 is opened. The puppet valve 210, which extends axially, is passed through a bore at the center of the stopper 44 in an axially slidable manner, and is projected out of the stopper 44 to form a radially projected engaging portion 212 at its free end. A spring 214 having a relatively weak spring coefficient is arranged between the puppet valve 210 and the stopper member 44 for urging the puppet valve 210 to seat on the outer edge of the intake passageway 1-4. FIG. 30 shows a condition where the rotary valve 17 together with the control piston 49 is in its leftmost position so that the intake passageway Pr' communicates with the piston chamber Pv' at an angle $\theta_2$ so that compression capacity at the rear side (right handed) of the piston cylinders Sp' is minimized. The puppet valve 210 is closed so as to shut off the intake passageway 1-4, so that the introduction of the refrigerant gas to the left handed piston chambers Sp is stopped. Namely, the capacity of refrigerant from the left side piston chambers Sp is zero.

The movement of the rotary valve 210 in the right hand direction by the control valve 50 to a position where the variable intake passageway Pr' engages the intake port Pa' at an angle $\theta_1$ maximizes the capacity of the right handed piston chambers Sp'. In this case, the stopper member 44, which moves axially together with the rotary valve 17, is still detached from the engaging portion 212 of the puppet valve 210, so that the puppet valve 210 is still maintained at its closed position. Following this a further axial movement of rotary valve 17 caused by the movement of the control piston 49 finally causes the stopper member 44 to engage with the engaging portion 212, which detaches the puppet valve 210 from the valve seat, so that the intake passageway 1-4 is connected to the intake pressure chamber Vs. As a result, the supply of refrigerant gas to the left side piston chambers Sp is commenced. In this case, a step like increase in the output capacity of the refrigerant gas is obtained. From the view point of an idealized compressor operation, a continuously changing capacity from the minimum valve to the maximum valve via a medium value is desirable, however, a continuous change in the outlet volume from the middle value to the maximum value is rarely required. Contrary to this, with such a control as in the embodiment in FIG. 30 it is sufficient that the capacity continually change in a range between the minimum value to the medium value, and be controlled to the maximum level in a step like manner so as to obtain a "cool down" operation. Namely, a cool down operation is carried out until a target temperature is obtained, and after the target temperature is obtained, a change in the outer volume between the minimum value and the medium value is sufficient to obtain a desired precise control of the temperature. Therefore, the simplified ON-OFF capacity control at the front side piston chambers Sp by the puppet valve 210 is sufficient from an operational point of view and costs can be reduced.

In the 10th embodiment in FIG. 30, it is explained that an increase in pressure at the control pressure chamber Vc reduces the outlet capacity. However, it will be possible to obtain a construction such that an increase in pressure at the chamber Vc increases the capacity. In order to do this, in FIG. 32, the axial position of the portion of the intake passageway of the larger angle and the portion of the intake passageway of the smaller angle are reversed.

FIGS. 34 to 36 show an 11th embodiment, which is a modification of the embodiment in FIG. 34, and therefore difference therefrom will be explained. In place of the provision of the enlarged diameter portion 1-3 of the shaft 1 constructed as an integral type rotary valve defining the fixed intake passageway Pr, a sleeve member 62, which is separate from the shaft 1, is provided so that the sleeve member 62 is fixedly connected to the shaft 1 by means of a fixing member 63. The sleeve member 62 is formed with a slit 62-1 as a fixed intake passageway Pr extending along a rotating angle for about 130 degrees. This construction is advantageous from the view point of manufacturing, since the slit 62-1 can be easily machined on the sleeve 62 as a separate part.

In the embodiment in FIG. 34, an intake passageway 36 is formed obliquely in the shaft 1, which is opened to an axial bore 1-4 as an intake passageway formed in the shaft 1. A slide valve 66 is coaxially arranged in the axial bore 1-4. The slide valve 66 has an enlarged diameter end 66-1 having an outwardly opened cup shape, which functions as a spool valve for opening or closing the intake passageway 36 for obtaining a step like capacity control as also explained with reference to the embodiment in FIG. 30. A compression spring 67 is arranged in the cup shaped portion 66-1 for urging the slide valve 66 in the right hand direction in FIG. 34. The slide valve 66 has, at the other end opposite the cup shaped valve portion 66-1, a piston portion 66-2 that is axially and slidably inserted in a cylinder bore 17-1 of a rear rotary valve 17 so that a chamber Vx is formed. The rotary valve 17, which also functions in relation to the control piston 49 in the previous embodiment in FIG. 30, is axially and slidably inserted in a cylinder bore 11-2 formed in the housing 11, so that a control pressure chamber Vc is created on the rear side of the rotary valve 17. The rotary valve 17 forms an opening 17-2 for opening the control pressure in the control pressure chamber Vc to the chamber Vx, which causes the control pressure to also be applied to the slide valve 66.

When the pressure in the control chamber Vc as created by the control valve 50 is high, the rotary valve 17 moves in the left-hand direction in FIG. 33 against the force of the spring 250. Prior to or after this movement of the rotary valve 17, depending on the strength of the spring 67, due to the control pressure in the chamber Vx opened to the control pressure chamber Vc via the opening 17-2, the slide valve 66 is moved in the same direction so as to assume a position where the spool valve portion 66-1 opens the intake port 36, so that the intake pressure chamber Vs is opened to the intake passageway 36, which allows the refrigerant gas to be admitted into the piston chamber Pv via the corresponding intake port Pa.

A reduction of the control pressure in the control pressure chamber Vc due to the operation of the control valve 50 causes the rotary valve 17 to move in the right hand direction in FIG. 34 due to the return force of the spring 250. Prior to or after commencement of the movement of the rotary valve 17, the valve rod 66 moves in the right handed direction in FIG. 34 due to the return force of the spring 67 thereby causing the spool valve portion 66-1 to close the intake port 36 and disconnecting it from the intake pressure chamber Vs. As a result, refrigerant gas is prevented from being introduced into the front side piston chambers Pv, which reduces the capacity of the compressor by 50%. In the case where the slide valve 66 moves first in the right hand direction as in FIG. 34, which is followed by movement of the rear rotary valve 17 in the same direction, by a relatively large spring coefficient value of the spring 67, the capacity of the front side piston chambers Pv is, first, made zero, and, then, the rotary valve 17 is moved in the right hand direction, thereby continuously reducing the capacity of the right side piston chamber Pv' in accordance with the reduction of the control pressure in the control chamber Vc.

In the 11th embodiment in FIG. 34, the rear rotary valve 17 functions as a control piston. In order to axially move the rotary valve 17 while rotating together with the drive shaft 1, the tubular end portion of the rotating shaft 1 is formed with four axially extending outwardly opened equiangular spaced slits 254. An annular stopper 256 is arranged in the tubular end portion of the shaft 1, and the annular stopper 256 is, as shown in FIGS. 35 and 36, formed with four equiangular spaced, radially extending four guide pins 258, that are axially and slidably inserted in the respective axial slits 254 formed in the tubular end portion of the shaft 1. The rear rotary valve 17 is formed with four equiangular spaced, axially inwardly opened recesses 260, in which the radially outward ends of the guide pins 258 are inserted, so that the rotational movement of the shaft 1 is transmitted to the rotary valve 17. The axial movement of the rotary valve 17 is allowed because the guide pins 258 are axially guided along the axial slits 254 on the tubular end of the rotating shaft 1. The compression spring 250, at its rear end, makes contact with the annular stopper 256, so that the rear rotary valve 17 is urged in the axially right hand direction. Similar to the 10th embodiment in FIG. 32, the rear rotary valve 17 is formed with a variable intake passageway Pr' that functions to control the introduction of a variable amount of refrigerant into the rear side piston chambers Sp' in accordance with the axial position of the rotary valve.

FIG. 37 shows a 12th embodiment, which features a rotary slide valve 300 provided to function as the puppet valve in the 10th embodiment or the slide valve in the 11th embodiment and the rotary valve. Namely, the rotary slide valve 300 has a slide valve portion 302 defining an intake passageway Pr' and a rotary valve portion 304 extending integrally from the slide valve portion. A rear casing 11 is formed with a boss portion 11-1 that is opened to the space inside the rotary slide valve 300, so that an intake pressure chamber Vs is formed inwardly of the rotary slide valve 300 and the boss portion 11-1, which is in communication with a refrigerant gas source (not shown). The drive shaft 1 has a tubular portion 1-6 defining an inner annular partition wall portion 310, with which the slide valve portion 302 is axially slidable. The slide valve portion 302 has at its portion near its closed end diametrically opposite openings 312 opened to the control pressure chamber Vs inside the rotary slide valve 300. Arranged in an annular space between the shaft and the cylinder wall is a fixed rotary valve 316 having a fixed intake passageway Pr cooperating with the intake ports Pa of the respective piston chambers Pa upon completion of one rotation. The rotary slide valve 300 has a spline portion 305 that engages with a spline portion 1-8 at the inner surface of the tubular portion of the drive shaft 1, so that the rotary slide valve 300 rotates together with the drive shaft 1, while the rotary slide valve 300 is axially slidable with respect to the shaft 1. A spring 330 is provided for urging the rotary slide valve 300 so that it is moved in the right hand direction.

An annular piston 332 is provided in an annular cylinder bore 116 in the casing 11 so that an annular control pressure chamber Vc is formed. Inner and an outer seal rings 332 and 342 are provided on the piston 332 for obtaining a desired sealing function. Similar to the previous embodiment, the control pressure chamber Vc is under a control pressure obtained by a control valve that is not shown but may have a similar construction as explained with reference to the former embodiments.

In the operation, the refrigerant gas is introduced into the intake pressure chamber, and when the pressure in the control pressure chamber Vc is low, the rotary slide valve 300 is in its right hand position, where the slide valve portion 302 is a position to close the valve openings 312. As a result, the refrigerant gas is prevented from being introduced into the front (left handed) piston chambers Sp. In this case, the degree of the opening of the intake passageway Pr' to the right hand (rear) piston chambers Sp' is controlled in accordance with the axial position of the rotary slide valve 300 so as to continuously vary the capacity of the compressor. Namely, the capacity is continuously changed up to ½ of the full capacity from the minimum capacity. An increase in pressure in the control chamber Vc causes the rotary slide valve to be situated so that the valve openings 312 are opened to the intake pressure chamber Vs so that the refrigerant gas is also introduced into the left hand piston chambers Sp. As a result, a step like increase in the capacity of the compressor from half capacity to full capacity is obtained.

While embodiments of the present invention are explained with reference to attached drawings, many modifications and changes can be made by those skilled in this art without departing from the scope and spirit of the present invention.

We claim:

1. A variable capacity swash plate type compressor comprising:

a rotating shaft adapted for connection to a source of a rotating movement;

a cylinder block with which the rotating shaft is rotated, the cylinder block forming a plurality of circumferentially spaced cylinder bores each extending parallel to an axis of the rotating shaft;

a plurality of pistons axially and slidably stored in the respective cylinder bore so that piston chambers are formed on respective sides of the pistons;

a swash plate fixedly connected to the rotating shaft, which is connected to the pistons to obtain an axial reciprocal movement of the piston upon rotation of the shaft;

the piston chambers each having a volume which alternately increases and decreases upon the axial reciprocal movement of the corresponding pistons;

the cylinder block forming therein an intake pressure chamber that is connected to a source of a medium to be compressed, and a outlet pressure chamber for removing the medium as compressed;

an intake means for controlling an introduction of the medium from the intake pressure chamber to the piston chambers; and a discharge means for controlling a discharge of the medium from the piston chambers to the outlet pressure chamber;

said intake means comprising:

a rotary valve that is axially slidable with respect to the shaft while rotating together with the shaft, and a control means for controlling an axial position of the rotary valve on the shaft;

the rotary valve being for obtaining successive control of a communication between the intake pressure chamber and the circumferentially spaced piston chambers at respective ranges of a rotating angle upon one complete rotation of the rotary valve for introducing the medium to the respective piston chambers; said angle being controlled in accordance with the axial position of the rotary valve as obtained by said axial position control means.

2. A compressor according to claim 1, wherein said cylinder block defines a valve bore coaxial to the shaft, and a plurality of circumferentially spaced intake ports, each having a first end opened to the corresponding piston bore and a second end opened to the valve bore, and wherein said rotary valve is housed in the valve bore, and forms, on its outer surface, a groove extending circumferentially from an angle corresponding to a stroke movement of the piston for forming an intake passageway that is in communication with the intake pressure chamber; said groove forming an edge extending for a range of a rotating angle of the rotary valve so that said edge engages with the intake port of the piston chamber at a different axial position of the rotary valve upon an axial movement of the rotary valve, so that the rotating angle where the intake passageway is in communication with the intake port for the respective piston chamber varies in accordance with the axial position of the rotary valve for obtaining varying capacities.

3. A compressor according to claim 2, wherein the edge extends so as to incline with respect to an axis of the shaft to obtain a substantially triangle shaped intake passageway when developed.

4. A compressor according to claim 1, wherein said control means comprises a load means for generating an axial load applied to the rotary valve so that the rotary valve is located at a position on the shaft in accordance with an axial force.

5. A compressor according to claim 4, wherein said load generating means compresses a control pressure chamber formed on one side of the rotary valve in which a control pressure is generated so as to generate a gas pressure force caused by gas pressure in the control pressure chamber, and a spring generating a spring force urging the rotary valve in a direction opposite the gas pressure force.

6. A compressor according to claim 5, further comprising a control valve that is responsive to pressure at at least one location in the compressor, for creating a control pressure opening to the control pressure chamber.

7. A compressor according to claim 6, wherein said control valve comprises a pressure receiving member that responds to an intake pressure in the intake pressure chamber, and a valve means connected to the pressure receiving member for controlling the gas pressure in the control pressure chamber.

8. A compressor according to claim 7, wherein said valve means comprises a first port opened to the intake pressure chamber, a second port opened to the control pressure chamber, and a third port opened to the outlet chamber, and a valve member for controlling an introduction of the intake pressure or the outlet pressure so that a desired control pressure is obtained at the third port.

9. A compressor according to claim 5, wherein the rotary valve comprises a first portion in which the intake port is formed, and a second portion to which the gas pressure at the control pressure chamber acts.

10. A compressor according to claim 4, wherein said load generating means comprises an axially displaceable pressure receiving member arranged on one side of the rotary valve so as to be remote therefrom; to which pressure receiving member, a gas pressure is applied, a load transmitting member connected to the pressure receiving member; the load transmitting member cooperating with the rotary valve to transmit an axial load from the load transmitting member to the rotary valve, a first spring for cooperating with the rotary valve on a side opposite the load transmitting member for generating a spring force in one axial direction, and a second spring for cooperating with the load transmitting member for generating a spring force in an opposite axial direction.

11. A compressor according to claim 10, wherein said pressure receiving member is formed as a flexible diaphragm member.

12. A compressor according to claim 10, wherein said load transmitting member is a member projected from the pressure receiving member toward an end surface of the rotary valve axially facing the rotary valve.

13. A compressor according to claim 10, wherein said load transmitting member is a thrust bearing arranged between axially facing surfaces of the pressure receiving member and the rotary valve.

14. A compressor according to claim 1, wherein the rotating angle where the intake passageway is connected to the piston chamber commences at a position around top dead center and terminates at a position before bottom dead center of the respective pistons.

15. A compressor according to claim 1, wherein the rotating angle where the intake passageway is connected to the piston chamber commences at a position around top dead center and terminates at a position after bottom dead center.

16. A variable capacity swash plate type compressor comprising:

a rotating shaft adapted for connection to a source of a rotating movement;

a cylinder block with which the rotating shaft is rotated; the cylinder block forming a plurality of circumferentially spaced cylinder bores each extending parallel to an axis of the rotating shaft;

a plurality of double headed pistons axially and slidably stored in the respective cylinder bores, each piston forming on its sides axially spaced first and second piston chambers;

a swash plate fixedly connected to the rotating shaft, which is connected to the pistons to obtain an axial reciprocal movement of the piston upon rotation of the shaft;

the first and second piston chambers each having a volume which alternately increases and decreases upon an axial reciprocal movement of the corresponding pistons;

the cylinder block forming therein an intake pressure chamber that is connected to a source of a medium to be compressed, and axially spaced first and second outlet pressure chambers for removing the medium as compressed;

an intake means for controlling an introduction of the medium from the intake pressure chamber to the first and second piston chambers; and a discharge means for controlling a discharge of the medium from the first and second piston chambers to the first and second outlet pressure chambers;

said intake means comprising:

axially spaced first and second rotary valves that are axially slidable with respect to the shaft while rotating together with the shaft, a control means for controlling an axial position of the rotary valves on the shaft, and a relating means for obtaining axial movements of the first and second rotary valves along the shaft in accordance with a preferably timed relationship;

said first and second rotary valves being for obtaining successive control of a communication of the intake pressure chamber with the circumferentially spaced first and second piston chambers, respectively, at respective ranges of a rotating angle upon one complete rotation of the rotary valve for introducing the medium to the respective first and second piston chambers; said angle being controlled in accordance with the axial positions of the rotary valves as obtained by said axial position control means.

17. A compressor according to claim 16, wherein said relating means comprises a push rod movably housed in the shaft; said push rod having axially spaced ends, with one of which, one of the first and second rotary valves contacts, and a radially extending guide pin, with which another end of the push rod contacts; the guide pin engaging with the other of the first and second rotary valves so that the axial movement as generated by the control means is transmitted between the first and second rotary valves.

18. A compressor according to claim 16, wherein said ranges of the rotating angle for introduction of the medium to the respective first and second piston chambers are identical for the first and second rotary valves.

19. A compressor according to claim 16, wherein said range of the rotating angle is different between the first and second rotary valves.

20. A compressor according to claim 16, wherein a control means comprises a first or control pressure chamber formed on one side of the first rotary valve in which a control pressure is generated so as to generate a gas pressure force caused by gas pressure in the control pressure chamber, a first stopper member for limiting an axial position of the first rotary valve, and a spring for urging the first rotary valve toward the first stopper member, and wherein said relating means comprises a second stopper member for limiting an axial movement of the second rotary valve, second spring urging the second rotary valve toward the second stopper, a second chamber formed on one side of the second rotary valve remote from the second spring, and a passageway means for obtaining communication between the first chamber and the second chamber.

21. A compressor according to claim 20, wherein the first stopper is a circlip.

22. A compressor according to claim 20, wherein the second stopper is a circlip.

23. A compressor according to claim 16, wherein said cylinder block defines a first and second valve bore coaxial to the shaft, and an axially spaced array of circumferentially spaced intake ports, each having a first end opened to the corresponding piston bore and a second end opened to the corresponding valve bore, wherein said first and second rotary valves are housed in the first and second valve bores, respectively, and each of the rotary valves form, on its outer surface, a groove extending circumferentially at an angle corresponding to a stroke movement of the piston for forming an intake passageway that is in communication with the intake pressure chamber; each said groove forming an edge extending for a range of a rotating angle of the rotary valve so that said edge engages with the intake port of the piston chamber at a different axial position of the rotary valve upon an axial movement of the rotary valve, so that the rotating angle where the intake passageway is in communication with the intake port for the respective piston chamber varies in accordance with the axial position of the first or second rotary valve for obtaining varying capacities.

24. A compressor according to claim 16, wherein said control means comprises a load means for generating, for each of the first and second rotary valves, an axial load for urging it axially inward and an axial load for urging it axially outward.

25. A compressor according to claim 24, wherein said loading means comprises, for each of the first and second rotary valves, a spring for urging it in one of the axially inward and outward directions, and a chamber for generating a gas pressure for urging it in the opposite direction.

26. A compressor according to claim 25, wherein the spring for the first rotary value and the spring for the second rotary valve have different spring coefficient values.

27. A compressor according to claim 24, wherein it further includes a means for differentiating the pressure in the chamber of the first rotary valve from the pressure in the chamber of the second rotary valve.

28. A variable capacity swash plate type compressor comprising:

a rotating shaft adapted for connection to a source of a rotating movement;

a cylinder block with which the rotating shaft is rotated; the cylinder block forming a plurality of circumferentially spaced cylinder bores, each extending parallel to an axis of the rotating shaft;

a plurality of double headed pistons axially and slidably stored in the respective cylinder bore, each piston forming on its sides axially spaced first and second piston chambers;

a swash plate fixedly connected to the rotating shaft, which is connected to the pistons to obtain an axial reciprocal movement of the piston upon rotation of the shaft;

the first and second piston chambers each having a volume which alternately increases and decreases upon an axial reciprocal movement of the corresponding pistons;

the cylinder block forming therein an intake pressure chamber that is connected to a source of a medium to be compressed, and axially spaced first and second outlet pressure chambers for removing out the medium as compressed;

an intake means for controlling an introduction of the medium from the intake pressure chamber to the piston chambers; and a discharge means for controlling a discharge of the medium from the piston chambers to the outlet pressure chamber;

said intake means comprising:

axially spaced first and second rotary valves, the first rotary valve being axially slidable with respect to the shaft while rotating together with the shaft; the second valve always being at a fixed position of the shaft, a control means for controlling an axial position of the first rotary valves on the shaft, and said first and second rotary valves being for obtaining successive control of a communication between the intake pressure chamber and the circumferentially spaced first and second piston chambers, respectively, at respective ranges of a rotating angle upon one complete rotation of the rotary valve for introducing the medium to the respective first and second piston chambers;

the angle of the first rotary valve varying in accordance with the axial positions of the rotary valves as obtained by said axial position control means;

a valve means that is responsive to the axial movement of the first rotary valve for selectively controlling the introduction of the medium to the intake passageway for the second piston chambers, so that a capacity of the compressor changes between a variable mode where the capacity changes between a minimum value and substantially half of a maximum capacity, and a maximum mode where the capacity is maintained at a maximum value.

29. A compressor according to claim 28, wherein said second rotary valve is integrally formed with respect to the rotating shaft.

30. A compressor according to claim 28, wherein said second rotary valve is a member separate from the rotating shaft, and a means is provided for fixedly connecting the second rotary valve to the rotating shaft.

31. A compressor according to claim 28, wherein said valve means comprises a valve member for controlling the introduction of a medium to the corresponding intake passageway, and a means that is, responsive to the axial position of the first rotary valve, for controlling the operation of the valve member.

32. A compressor according to claim 31, wherein said valve member is a puppet type valve.

33. A compressor according to claim 31, wherein said valve member is a spool type valve.

34. A compressor according to claim 28, wherein said control means and valve means are integrally connected.

* * * * *